US008672165B2

(12) United States Patent
Wei

(10) Patent No.: US 8,672,165 B2
(45) Date of Patent: Mar. 18, 2014

(54) CONTAINERS WITH DISPENSING CAP AND METHODS OF MANUFACTURING THE SAME

(71) Applicant: Spherical Precision, Inc., Irvine, CA (US)

(72) Inventor: Tim T. Wei, Irvine, CA (US)

(73) Assignee: Spherical Precision, Inc., Irvine, CA (US)

( * ) Notice: Subject to any disclaimer, the term of this patent is extended or adjusted under 35 U.S.C. 154(b) by 0 days.

(21) Appl. No.: 13/682,675

(22) Filed: Nov. 20, 2012

(65) Prior Publication Data

US 2014/0027457 A1 Jan. 30, 2014

Related U.S. Application Data

(60) Provisional application No. 61/563,005, filed on Nov. 22, 2011.

(51) Int. Cl.

| | |
|---|---|
| ***B65D 51/20*** | (2006.01) |
| ***B65D 41/32*** | (2006.01) |
| ***B65D 51/22*** | (2006.01) |

(52) U.S. Cl.

CPC ..... *B65D 51/22* (2013.01); *B65D 41/32* (2013.01); *B65D 2543/00296* (2013.01)

USPC ..... 220/258.5; 220/258.3

(58) Field of Classification Search

CPC ..... B65D 51/22; B65D 51/20; B65D 2543/00296; B65D 41/32; B65D 2101/0023

USPC ..... 220/837, 836, 258.5, 258.3, 258.1, 220/256.1, 276, 266, 265, 254.3, 254.1; 215/256, 254, 253, 251, 250

See application file for complete search history.

(56) References Cited

U.S. PATENT DOCUMENTS

| | | | | |
|---|---|---|---|---|
| 1,955,559 | A | 4/1934 | Narrow | |
| 3,275,203 | A * | 9/1966 | Nossal et al. | 215/253 |
| 3,282,477 | A | 11/1966 | Henchert | |
| 3,424,330 | A * | 1/1969 | Marcel | 215/256 |
| 4,022,357 | A | 5/1977 | Dwinell | |
| 4,344,472 | A | 8/1982 | Larkin et al. | |
| 4,564,125 | A | 1/1986 | Esslinger | |
| 4,682,702 | A | 7/1987 | Gach | |
| 4,727,999 | A | 3/1988 | Gach | |
| 4,815,618 | A | 3/1989 | Gach | |
| 4,934,585 | A * | 6/1990 | Reil | 229/106 |
| 5,934,496 | A * | 8/1999 | Mogard et al. | 220/258.3 |
| 5,979,681 | A | 11/1999 | Varlet et al. | |
| 6,000,566 | A | 12/1999 | Kost | |
| 6,216,905 | B1 * | 4/2001 | Mogard et al. | 220/258.2 |
| 7,731,048 | B2 | 6/2010 | Teixeira Alvares et al. | |
| 2007/0095835 | A1 | 5/2007 | Lohrman et al. | |
| 2007/0131713 | A1 | 6/2007 | Hill | |
| 2008/0083691 | A1 | 4/2008 | Poynter et al. | |
| 2010/0213158 | A1 | 8/2010 | Kim | |
| 2010/0326022 | A1 | 12/2010 | Colangelo | |

* cited by examiner

*Primary Examiner* — Robert J Hicks

(74) *Attorney, Agent, or Firm* — Knobbe Martens Olson & Bear, LLP

(57) ABSTRACT

A container may have a breakaway tab forming an opening to dispense the contents. The container may be used for BB shot. The breakaway tab can have two opposing flat surfaces that extend upward away from the spout, and at least one cutout. The at least one cut out may be aligned with the flat opposing surfaces. The at least one cutout may facilitate easy removal of the tab to form a clean opening that is configured for proper dispensing of the contents.

12 Claims, 86 Drawing Sheets

CONTAINERS WITH DISPENSING CAP AND METHODS OF MANUFACTURING THE SAME

CROSS-REFERENCE TO RELATED APPLICATION

This application claims the benefit of U.S. Provisional Patent Application No. 61/563,005, filed Nov. 22, 2011, titled CONTAINERS WITH DISPENSING CAP AND METHODS OF MANUFACTURING THE SAME, the disclosure of which is incorporated herein by reference in its entirety.

FIELD OF THE INVENTION

Embodiments of this invention relate to improvements for containers that are configured to form an opening to dispense the contents.

BACKGROUND OF THE INVENTION

Some products such as ammunition projectiles (e.g., shot) are sold in containers that are enclosed by a cap. The caps can have a generally frustoconical shape, or spout-like shape, for easier dispensing of the shot. Typically the tip of the spout must be cut with a knife, scissors, or other tool, to create an opening to dispense the product inside in a controlled manner.

SUMMARY OF THE INVENTION

An aspect of at least one of the embodiments disclosed herein includes the realization that having to cut an opening in the spout of a container, which is often made of a hard and slippery plastic, requires sharp tools and increases the risk of injury to users, especially inexperienced users. Furthermore, the opening formed by the cut can be inconsistent and inaccurate, resulting in imprecise dispensing of the shot.

Embodiments of the present invention are directed to containers, particularly containers for BB shot, having a breakaway tab for forming an opening to dispense the contents. The containers can be molded or formed as a unitary body, or the containers can have a cap, with the improved breakaway tab.

The cap can be tapered inwardly towards a spout on top having an opening with a predetermined size. The breakaway tab can at least partially cover the opening, which can be configured for optimum dispensing of the contained product. For example, a container holding BB shot can have an opening that is large enough so that the shot do not clog the opening during pouring, but also is not so large that the shot are difficult to control during pouring. The tab can be integrally molded with the cap or can be attached to the cap by a variety of means, such as welding, adhesives, etc.

In some embodiments, the tab can be removed or snapped off without the use of knives, scissors, or any other tools. The cap is preferably made of a rigid plastic or other material that can be sheared without the use of tools. Preferably, the tab does not require large amounts of force to remove and can be removed easily with bare hands. The tab can be small in shape, yet still be functionally able to provide sufficient moment forces to break the material at the rim of contact between the tab and the intended opening of the spout. In some embodiments, the height of the tab can be at least approximately ⅛ inch and/or less than or equal to approximately 1½ inches. In some embodiments, the height of the tab can be at least approximately ¼ inch and/or less than or equal to approximately 1 inch. Preferably, the height of the tab is approximately ½ inch.

The removable tab can facilitate the formation of an accurate, pre-sized, pre-shaped opening on the cap for controlled pouring of the contents. In some embodiments, the size and shape of the opening can be specified by controlling the material thickness at the rim of contact between the tab and the intended opening of the spout. For example, the material thickness at the rim can be less than the material thickness of other portions of the cap such that the tab will break off along the thinner rim material, forming a predetermined opening. In some embodiments, the size and shape of the opening formed on the cap can be controlled by cutouts at the rim of contact, as explained further below.

The breakaway tab and spout can have pre-exiting cutouts disposed between them that can create starting points for the tearing or breaking of the tab from the container. For example, the breakaway tab can have a crescent shaped cutout on at least one side of the tab where shear forces are concentrated when the tab is pushed by the user. The concentrated shear forces form a starting point for tearing, facilitating a clean, decisive removal of the tab and allowing easy opening of the container.

The cutouts can be disposed between the tab and spout, such that the tab does not completely seal the opening of the spout. As discussed above, the slots produce weakened points between the tab and spout to help facilitate breaking of the tab away from the spout. As illustrated in the figures, the flat surfaces of the tab can be oriented so that pressing the flat surfaces initiates the breaks at the cutout locations. In some embodiments, the tab can be removed by pushing the tab once in a direction. In other embodiments, removal of the tab may require pushing the tab first in one direction, and then again in an opposite direction. In still other embodiments, removal of the tab may require pushing the tab back and forth three or more times. After the tab is broken off the cap during initial use, a cover can be used to close the opening.

In other embodiments, the openings can have cutouts with different sizes or shapes. By selecting the proper cutout size, material and tab design, the breakaway force required for opening can be tailored for particular situations. The cutouts can assume varying sizes and shapes based on design requirements to achieve a specified level of ease or difficulty for opening the container, and for pouring the contents. For example, in some embodiments the force required to open a BB shot container can be configured so that the cap cannot be opened by small children. The shape and size of the cutouts can also be customized to form the appropriate size and shape of the final opening to achieve optimum or desired dispensing of the contents.

The breakaway tab can advantageously be formed on the container with minimal increase in production costs. The breakaway tab can be integrally molded with the rest of the container or cap, which can result in substantially no cost increase in container production when compared to a similar container with a sealed spout.

In one embodiment of the invention, the container comprises a container body, a cap, a breakaway tab, and at least one pre-existing cutout. The cap is tapered inwardly towards a spout having an opening. The breakaway tab at least partially covers the opening in the spout. The at least one pre-existing cutout is disposed between the tab and the spout such that the tab does not completely seal the opening of the spout. The at least one cutout produces weakened points between the tab and spout to facilitate breaking of the tab away from the spout by pushing against the tab. The cap may be made of a plastic material. The cap may be of a generally frustoconical or spout-like shape. The cap may be integral with the container body or may be attachable to the container body. The breakaway tab may have two flat opposing surfaces. If the breakaway tab has two flat opposing surfaces, the container may have two pre-existing cutouts, each aligned with one of the two flat opposing surfaces. The breakaway tab may be integral with the cap. The at least one pre-existing cutout may have a crescent shape. The container may further comprise a cover coupleable to the cap and configured to cover the tab and the opening in the spout.

In another embodiment of the invention, the container comprises a container body and a cap portion. The cap portion comprises a spout and a breakaway tab. The tab partially covers the spout and is capable of being removed from the cap portion without the use of tools.

In another embodiment of the invention, the container comprises a container body and a cap. The cap comprises an engaging portion, a substantially frustoconical spout, a tab attached to or engaged with the spout, a cover, and a cover connector. Two pre-existing crescent-shaped cutouts are disposed between the tab and the spout. The tab can be snapped off of the spout using a pushing motion.

DETAILED DESCRIPTION OF THE PREFERRED EMBODIMENTS

Figure 1:
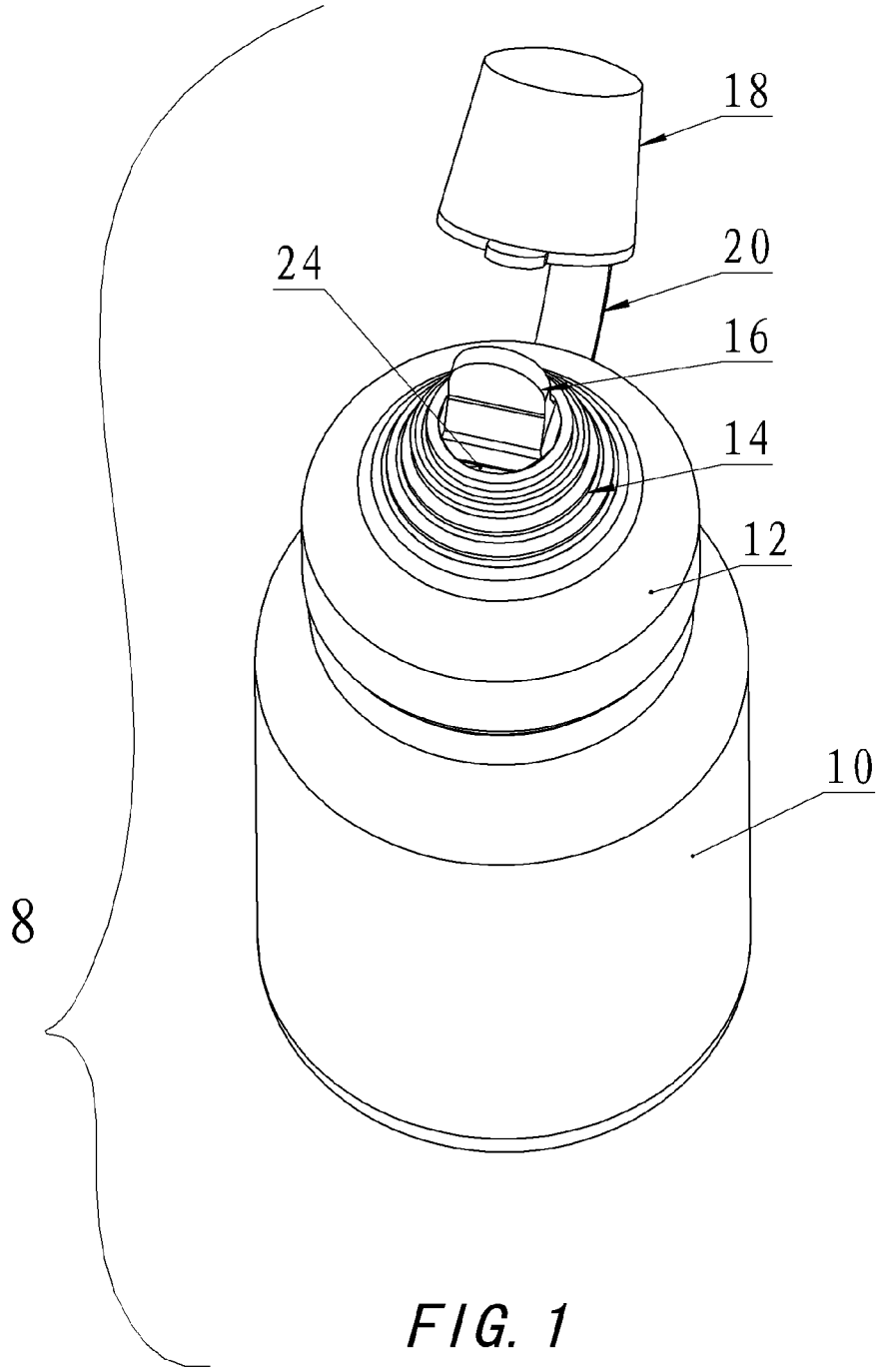
FIG. 1 is a top perspective view of a container having a cap with a cover uncoupled from the top, according to an embodiment of the present invention.
Figure 2:
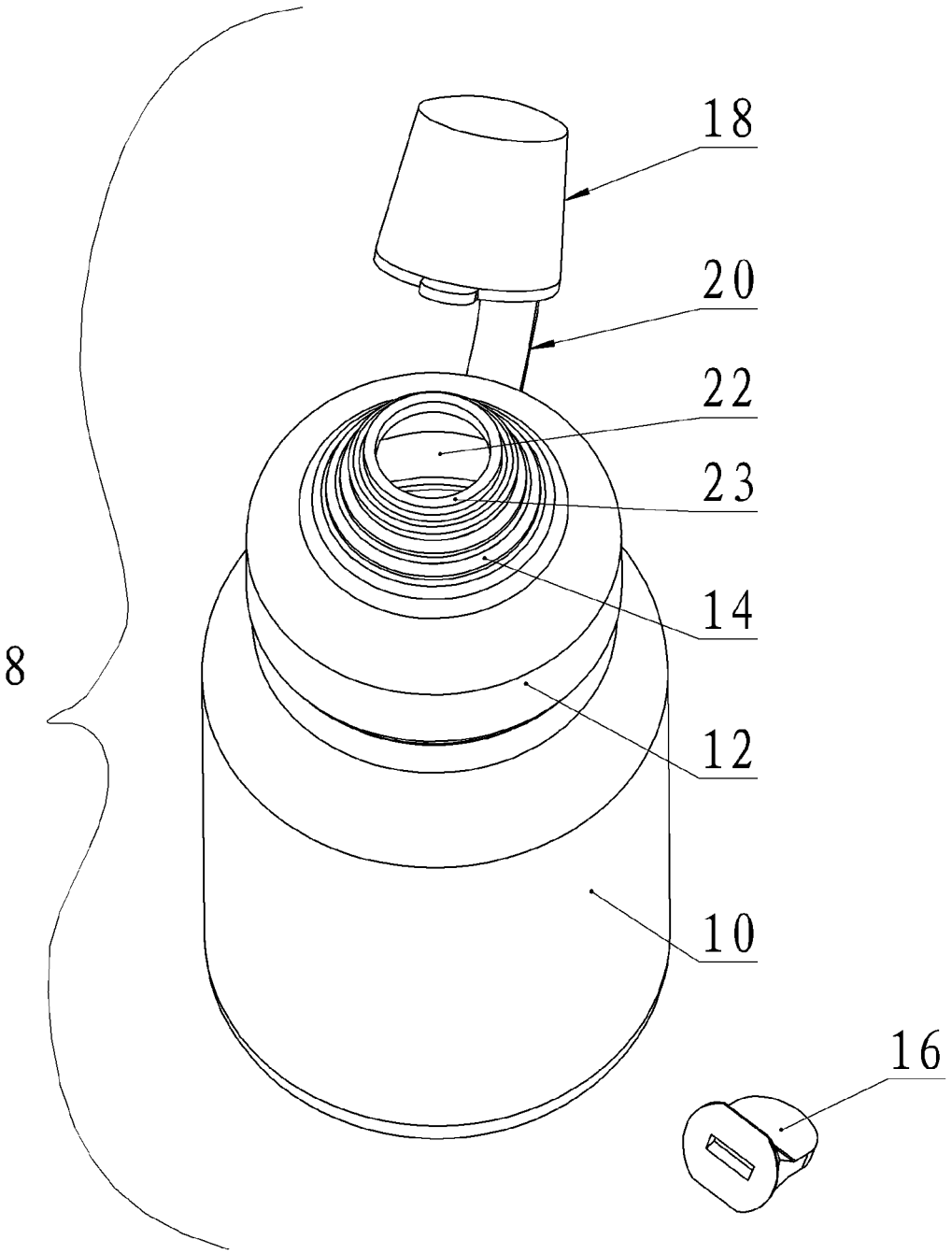
FIG. 2 is a top perspective view of the embodiment of the container illustrated in FIG. 1, with the tab removed from the cap.
Figure 3:
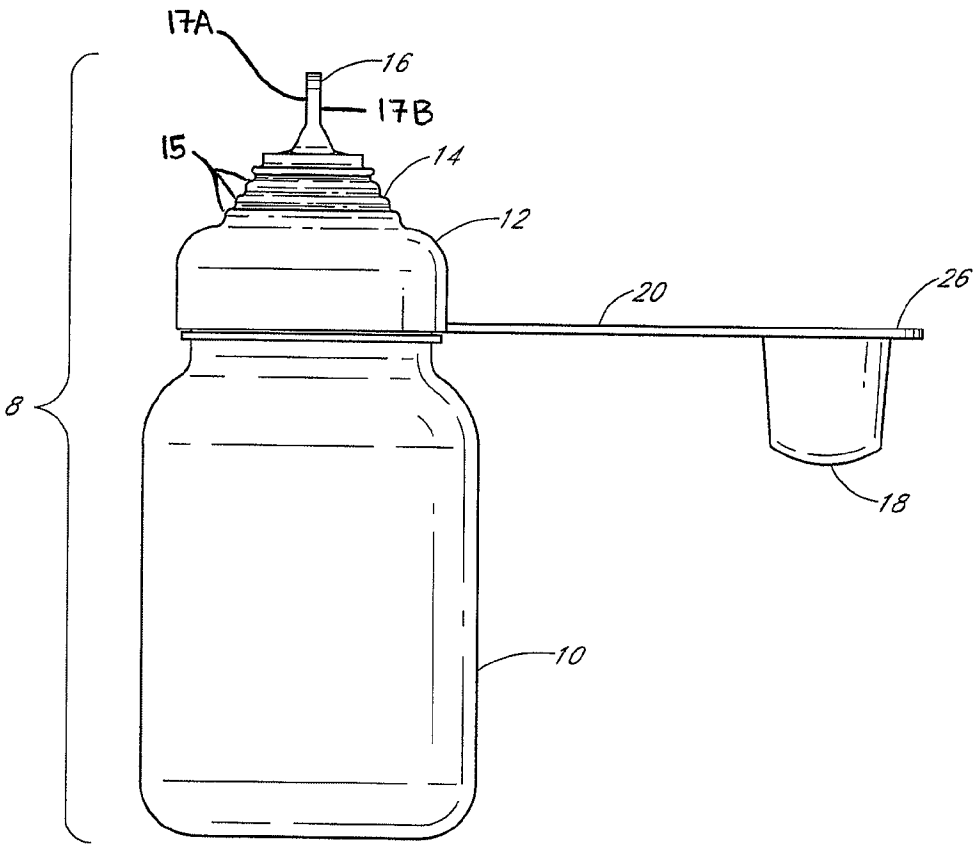
FIG. 3 is a side elevation view of a container having a cap with a cover uncoupled from the top, according to an embodiment of the present invention.
Figure 4:
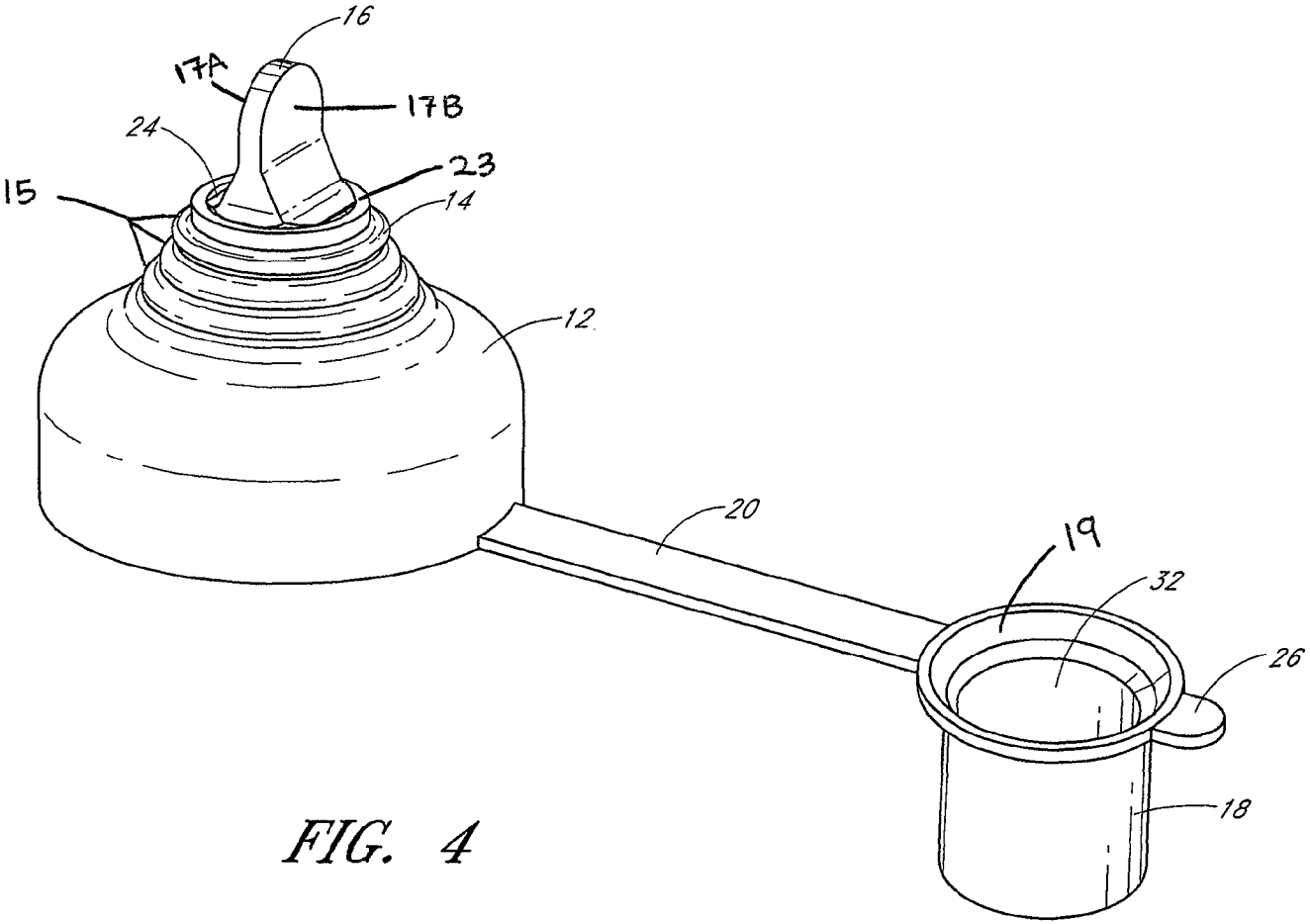
FIG. 4 is a top perspective view of the embodiment of the cap illustrated in FIG. 3.
Figure 5:
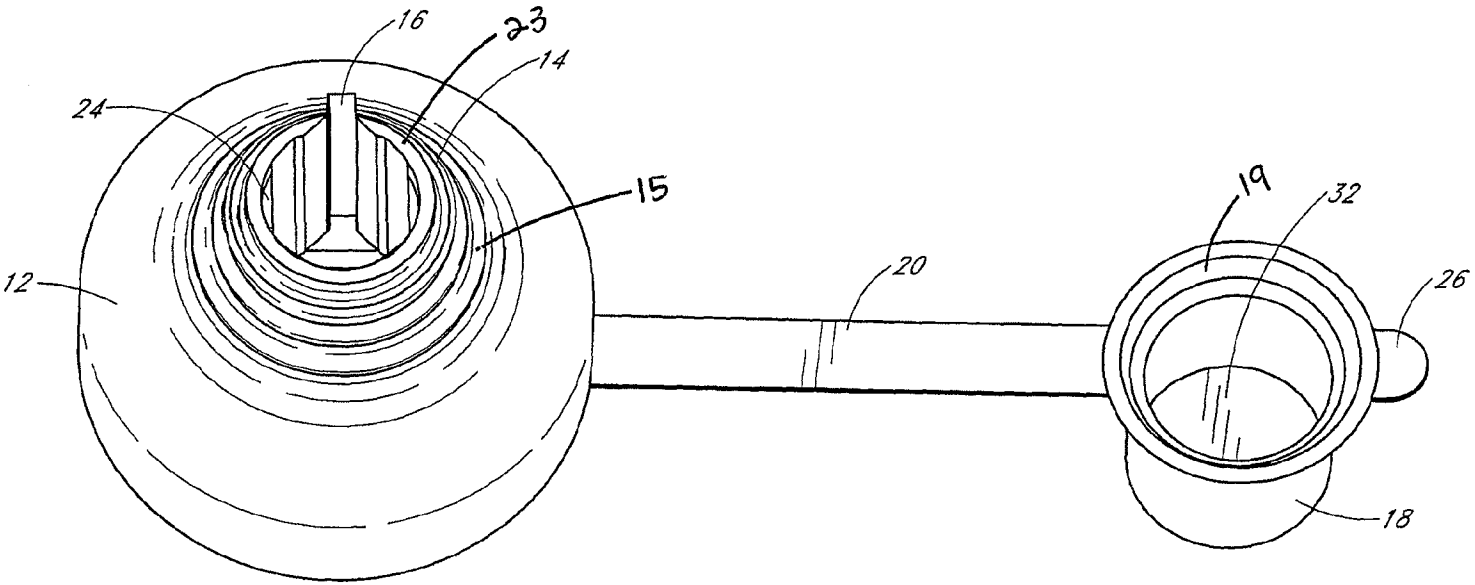
FIG. 5 is another top perspective view of the embodiment of the cap illustrated in FIG. 3.

In one embodiment a container 8 comprises a container body 10 and a cap 12, shown in FIGS. 1-3. The container body 10 may be permanently, removeably, or temporarily attached to the cap 12. Alternatively, the container body 10 and cap 12 may be molded or formed as a unitary body (not shown). The cap 12 comprises a spout 14, a tab 16 connected to the spout 14, a cover 18, and a cover connector 20 connecting the cover to the cap 12. The spout 14 may be generally of a frustoconical shape, or otherwise tapered inwardly, to aid in directing the contents of the container 8 out through the spout 14 when the container 8 is tipped or inverted. The spout 14 may also have ridges 15 or other annular features, such as rings that progressively decrease in diameter toward an upper end of the spout. The tab 16 is located on the top of the spout 14 and generally protrudes vertically in an upwards direction away from the spout 14. The cover connector 20 may be attached to the side of the cap 12 and extend to the rim 19 of the cover 18.

In one embodiment the tab 16 has a flat shape with opposing flat surfaces 17A and 17B that are generally parallel with each other and extend vertically upward away from the spout 14. The top of the tab 16 may have a rounded upper end. Adjacent to the opposing flat surfaces 17A and 17B the tab 16 increases in cross-sectional area towards the bottom of the tab 16. At the bottom of the tab 16 are two horizontal or almost horizontal surfaces that flange horizontally outward from the tab 16. The edges of the horizontal or almost horizontal surfaces may contact the rim 23 of the spout 14 and may help keep the tab 16 in place.

The tab 16 may partially cover an opening 22 at the upper end of the spout 14, with at least one cutout 24 disposed between the tab 16 and the spout 14, shown in FIGS. 4-9. The tab may have a flat bottom portion 36 that covers the opening 22 when the tab 16 is connected to the cap 12. The tab 16 can be integrally molded with the cap 12 or can be attached to the cap 12 by a variety of means, such as welding, adhesives, etc. The one or more cutouts 24 may be crescent-shaped or have a different shape. In one embodiment a crescent-shaped cutout 24 is disposed on one side of the tab 16. In another embodiment, two crescent-shaped cutouts 24 are disposed on opposite sides of the tab 16, aligned with the opposing flat surfaces 17A and 17B, such that the tab 16 does not completely seal the opening 22 of the spout 14. The size of the opening 22 may depend on the size of the contents housed within the container 8. The size of the opening 22 may be varied such that when the container 8 is inverted, the contents exit the container 8 at the desired pace. As an illustrative example, a container holding BB shot may have an opening that is large enough so that the shot do not clog the opening during pouring, but also is not so large that the shot are difficult to control during pouring.

Figure 8:
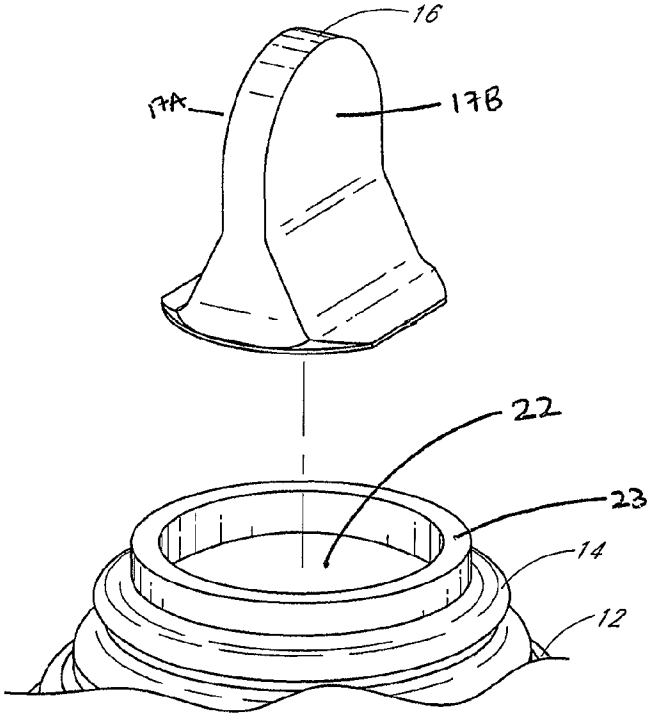
FIG. 8 is a close-up perspective view of the embodiment of the cap illustrated in FIG. 3, illustrating the spout after the tab has been removed.
Figure 7:
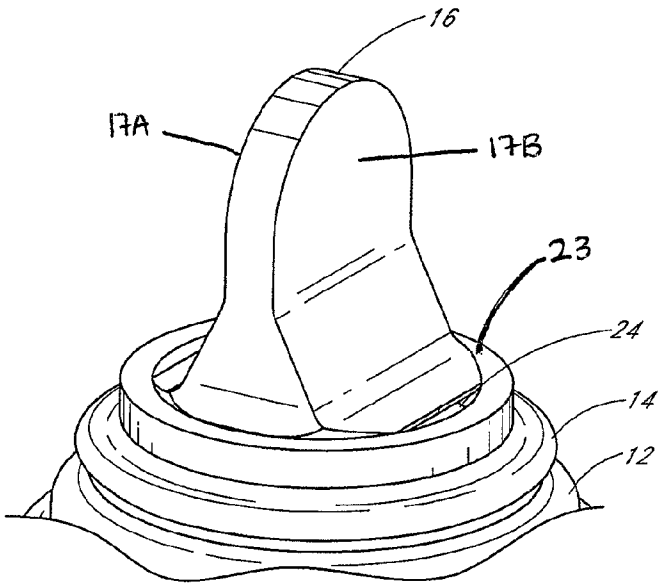
FIG. 7 is a close-up perspective view of the embodiment of the cap illustrated in FIG. 3, illustrating a tab attached to a spout.
Figure 9:
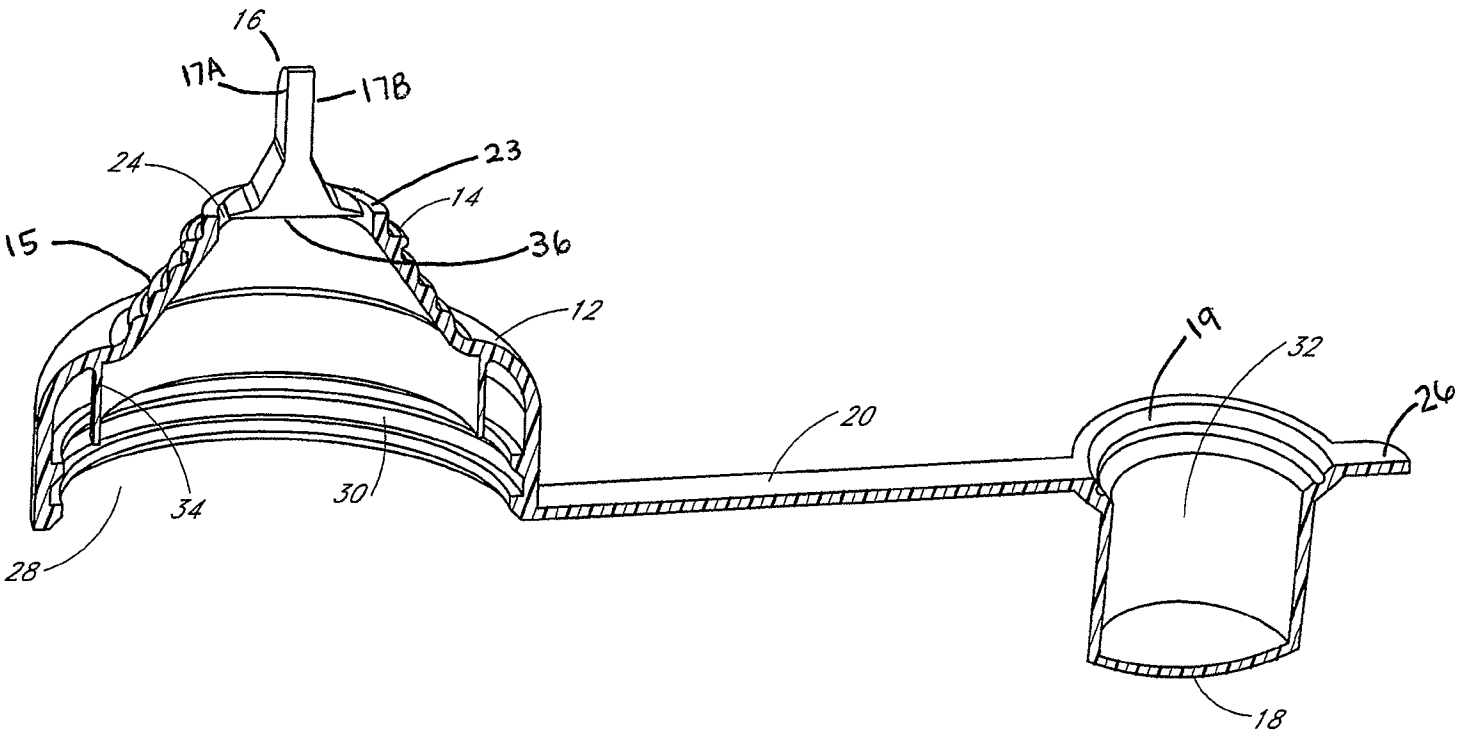
FIG. 9 is a side cross-sectional view of the embodiment of the cap illustrated in FIG. 3.

In some embodiments, the tab 16 can be removed or snapped off without the use of knives, scissors, or any other tools. FIG. 7 illustrates a tab 16 attached to a spout 14; FIG. 8 illustrates a tab 16 after it has become detached from a spout 14. Removing the tab 16 from the spout 14 may create an opening 22 in the spout 14. The cap 12 is preferably made of a rigid plastic or other material that can be sheared without the use of tools. Preferably, the tab 16 does not requires large amounts of force to remove and can be removed easily with bare hands. In one embodiment, to remove the tab 16, the user may grip the container body 10 with one hand and push on one of the flat surfaces (17A or 17B) of the tab 16 with the user's hand, preferably with the user's thumb. The cutouts 24 produce weakened points between the tab 16 and the spout 14 to help facilitate breaking of the tab 16 away from the spout 14. The flat surfaces 17A and 17B of the tab 16 can be oriented so that pressing one of the flat surfaces 17A or 17B initiates the breaks a the cutout locations 24. By pushing a flat surface of the tab 16, the user exerts a force on the tab 16, which is transferred to the base of the tab 16 where it is connected to the spout 14. The cutouts 24 help concentrate the shear forces, resulting from the user's pushing motion, on the corners of the cutouts 24, aiding in removing the tab 16 from the spout 14. The concentrated shear forces form a starting point for tearing, facilitating a clean, decisive removal of the tab 16 and allowing easy opening of the container 8. The tab 16 may be designed to easily dislodge from the spout 14 upon a single pushing motion by user utilizing only his bare hands. In other embodiments, removal of the tab 16 may require pushing the tab 16 first in one direction, and then again in the opposite direction. In still other embodiments, removal of the tab 16 may require pushing the tab 16 back and forth three or more times.

The tab 16 can be small in shape, yet still be functionally able to provide sufficient moment forces to break the material at the spout rim 23 between the tab 16 and the spout 14, creating an opening 22 in the spout 14. In some embodiments, the height of the tab 16 can be at least approximately ⅛ inch and/or less than or equal to approximately 1½ inches. In other embodiments, the height of the tab 16 can be at least approximately ¼ inch and/or less than or equal to approximately 1 inch. In still other embodiments, the height of the tab is approximately ½ inch.

The removable tab 16 can facilitate the formation of an accurate, pre-sized, pre-shaped opening 22 on the cap 12 for controlled pouring of the contents. In some embodiments, the size and shape of the opening 22 can be specified by controlling the material thickness at the spout rim 23 between the tab 16 and the spout 14. As an illustrative example, the material thickness at the rim 23 can be less than the material thickness of other portions of the cap 10 such that the tab 16 will break off along the thinner rim material, forming a predetermined opening 22. In some embodiments, the size and shape of the opening 22 formed on the cap 12 can be controlled by cutouts 24 at the rim of contact.

In other embodiments, the spout 14 can have cutouts 24 with different sizes or shapes. By selecting the proper cutout size, material, and tab design, the breakaway force required for opening can be tailored for particular situations. The cutouts 24 can assume varying sizes and shapes based on design requirements to achieve a specified level of ease or difficulty for opening the container 8, and for pouring the contents. As an illustrative example, in some embodiments the force required to open a BB shot container can be configured so that the cap cannot be opened by small children. The shape and size of the cutouts 24 can also be customized to form the appropriate size and shape of the final opening 22 to achieve optimum or desired dispensing of the contents.

The opening 22 can advantageously be formed on the container 8 with minimal increase in production costs. The tab 16 can be integrally molded with the rest of the cap 12, which can result in substantially no cost increase in container production when compared to a similar container with a sealed spout 14.

Figure 6:
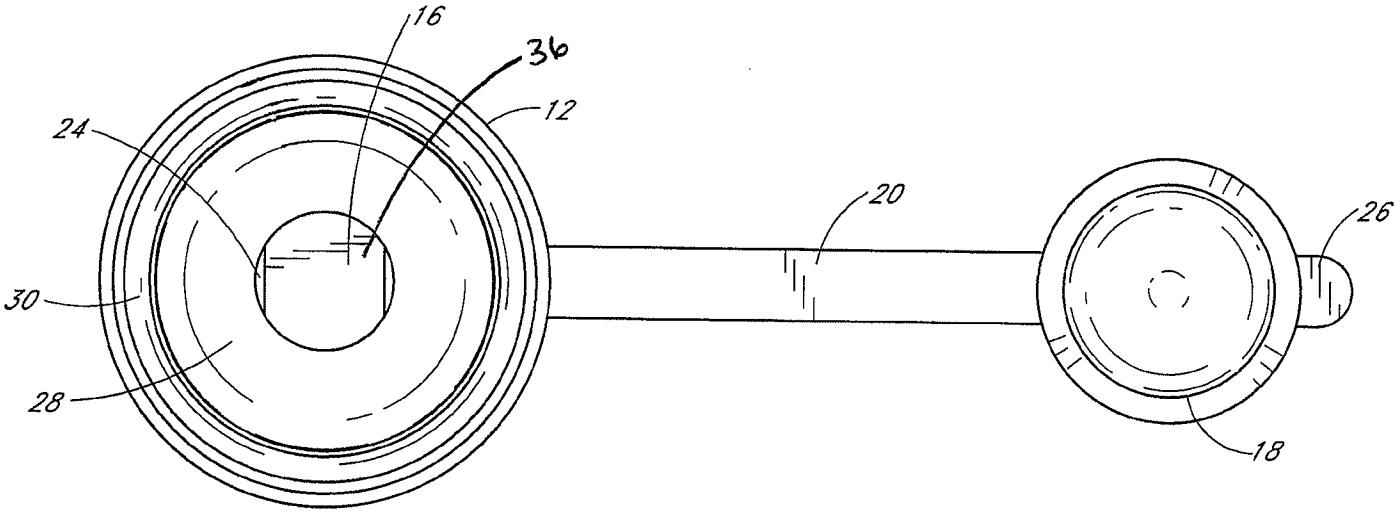
FIG. 6 is a bottom plan view of the embodiment of the cap illustrated in FIG. 3.

In one embodiment, the underside of the cap 12 comprises a bottom opening 28, which may contain an engaging portion 30, as shown in FIG. 6. The engaging portion 30 may permanently, removeably, or temporarily engage the top of the container body 10. The engaging portion 30 may contain various surface contours to aid in attaching to the container body 10. As an illustrative example, the container body 10 and/or the engaging portion 30 may contain screw threads such that the container body 10 and engaging portion 30 can be rotatingly engaged; or the container body 10 and/or engaging portion 30 may contain annular protrusions such that the container body 10 and engaging portion 30 permanently or temporarily snap together.

Figure 10:
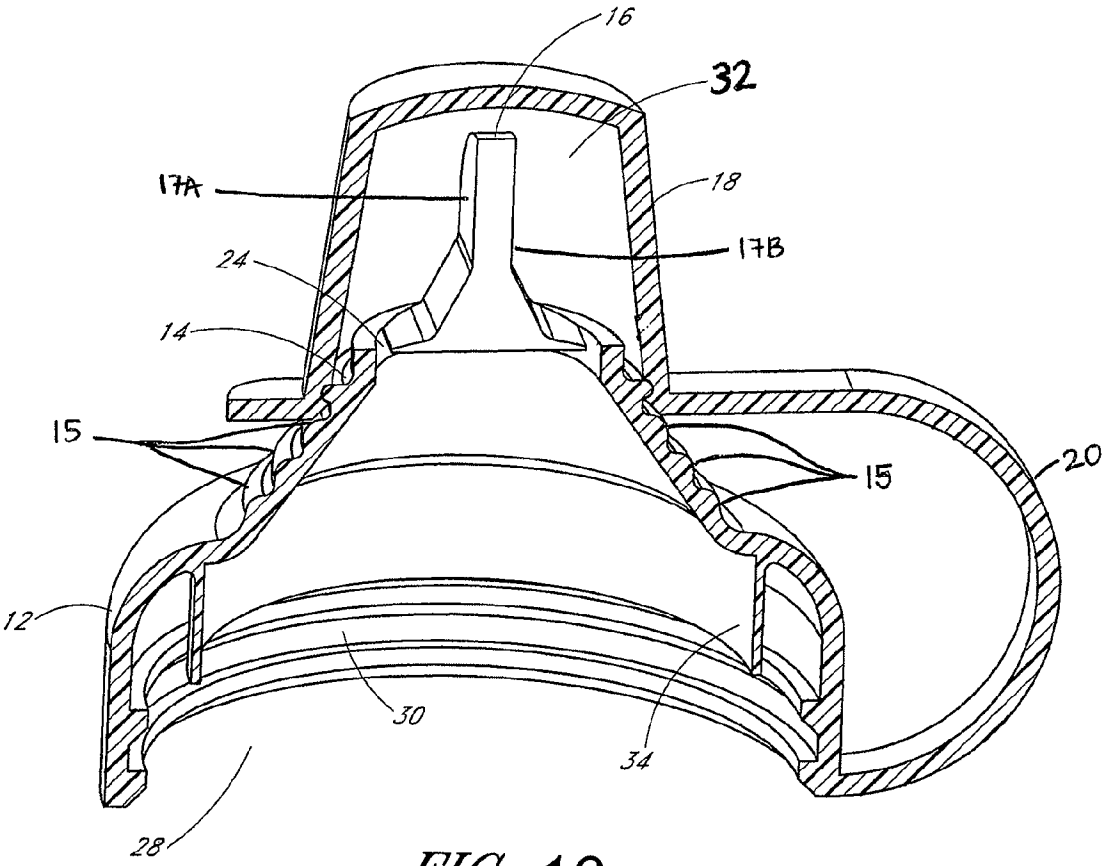
FIG. 10 is a side cross-sectional view of a cap with a cover coupled to the top, according to an embodiment of the present invention.
Figure 11C:
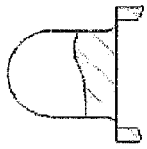
FIG. 11C is a partial cross-sectional view of the tab of FIGS. 11A and 11B.
Figure 11A:
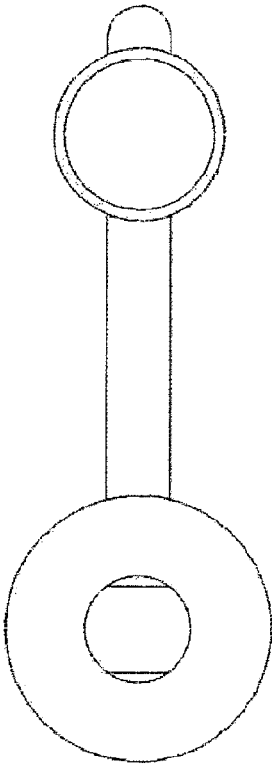
FIGS. 11A-11B are bottom and cross-sectional views of a cap portion with an attached cover and cover connector.
Figure 11B:
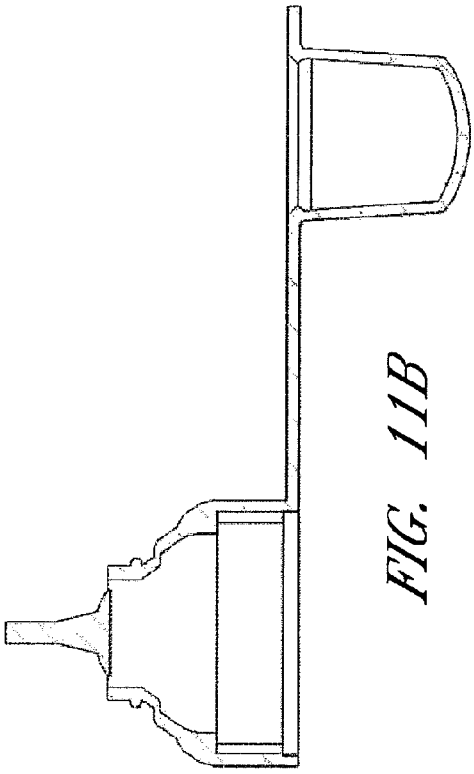
Figure 12A:
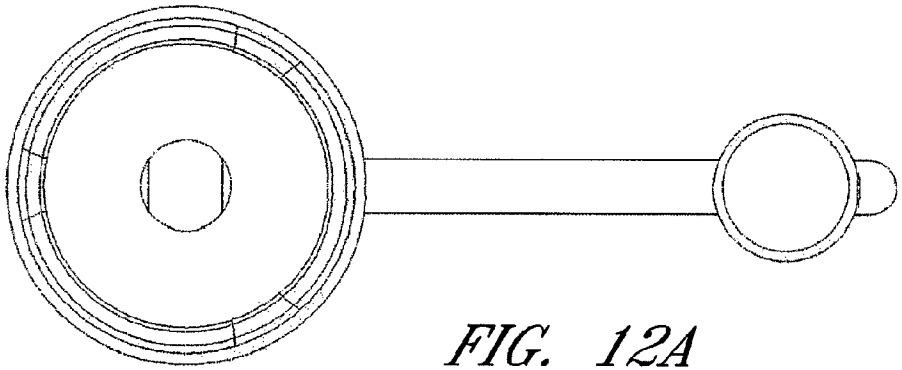
FIGS. 12A-12B are bottom and cross-sectional views of a cap portion with an attached cover and cover connector in another embodiment.
Figure 12B:
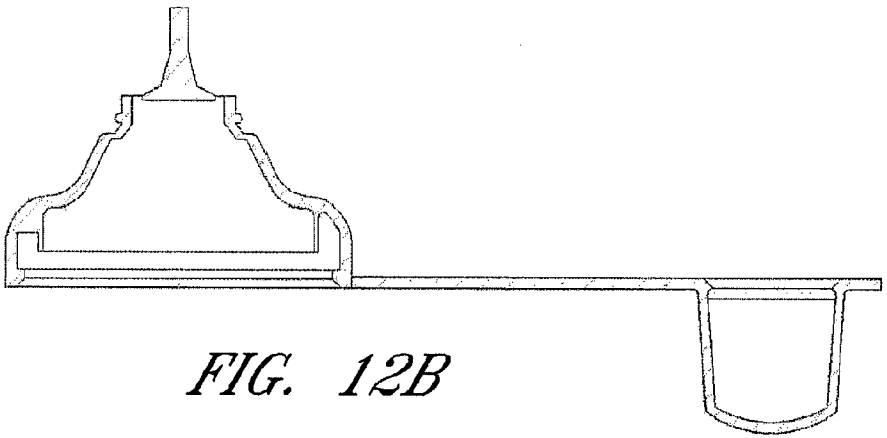
Figure 12C:
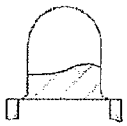
FIG. 12C is a partial cross-sectional view of the tab of FIGS. 12A and 12B.
Figure 13C:
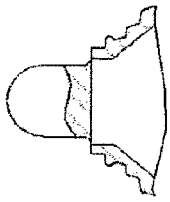
FIG. 13C is a partial cross-sectional view of the tab of FIGS. 13A and 13B.
Figure 13A:
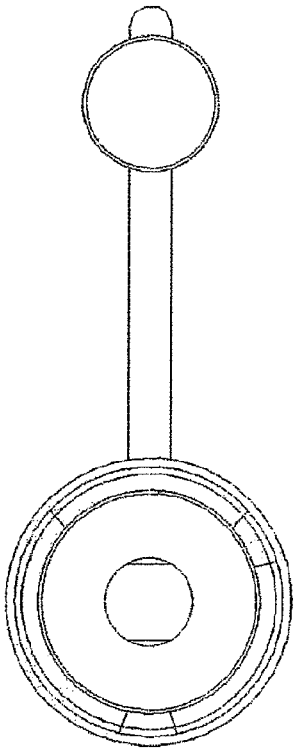
FIGS. 13A-13B are bottom and cross-sectional views of a cap portion with an attached cover and cover connector in another embodiment.
Figure 13B:
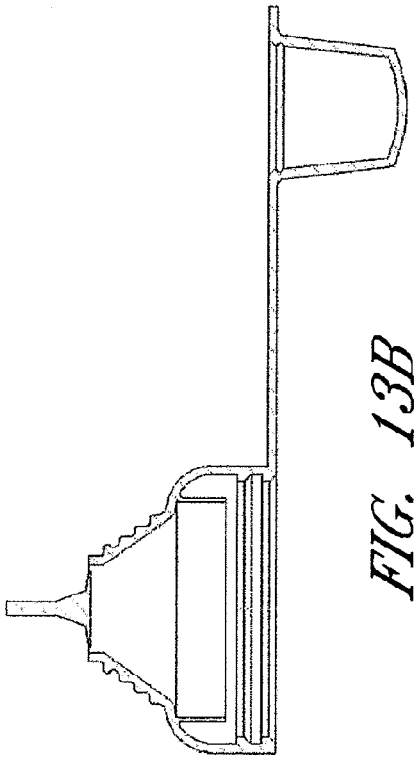
Figure 14B:
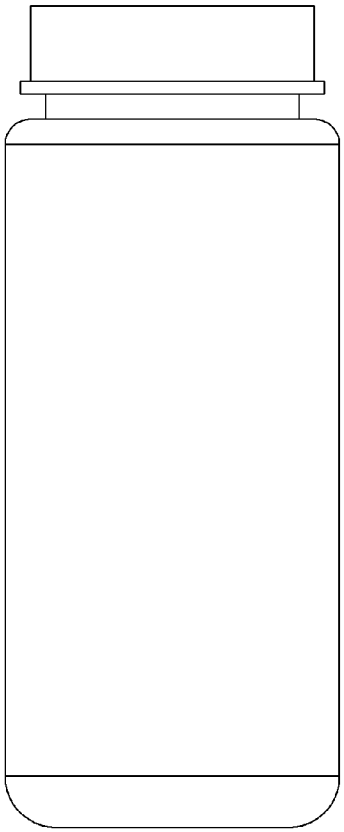
FIGS. 14A-D are a top perspective view, a side plan view, a bottom plan view, and a top plan view of an embodiment of a container body, respectively.
Figure 14A:
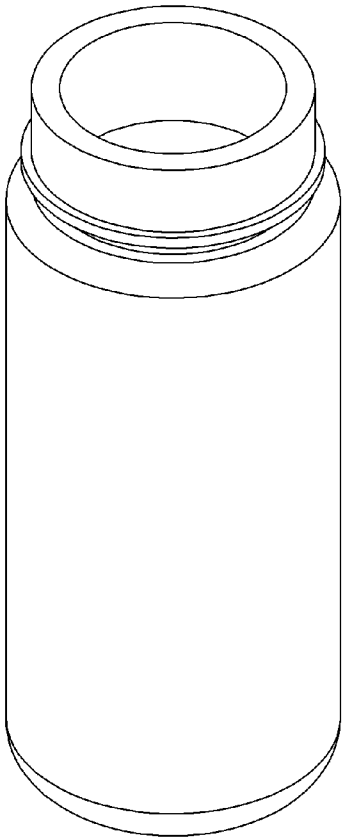
Figure 14D:
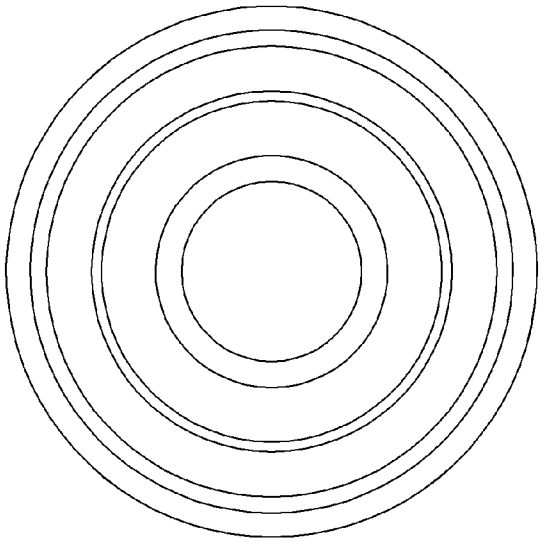
Figure 14C:
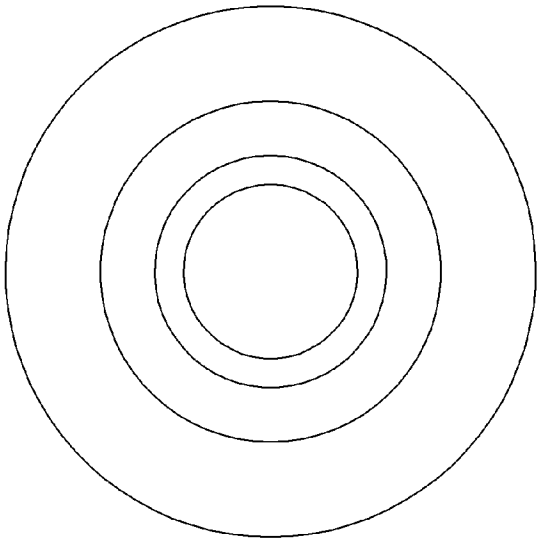
Figure 15B:
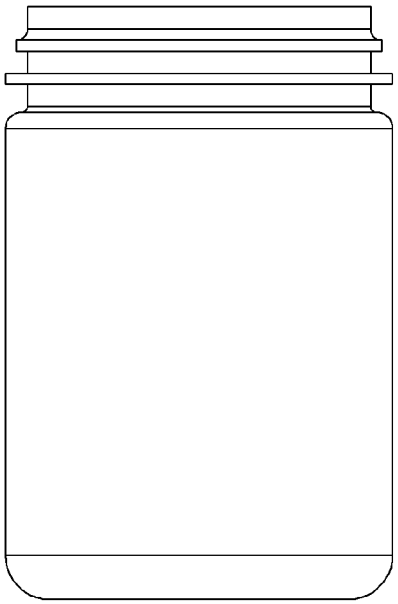
FIGS. 15A-D are a top perspective view, a side plan view, a bottom plan view, and a top plan view of an embodiment of a container body, respectively.
Figure 15A:
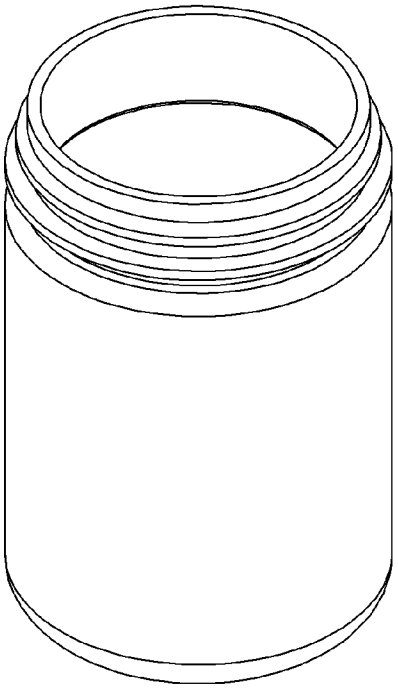
Figure 15D:
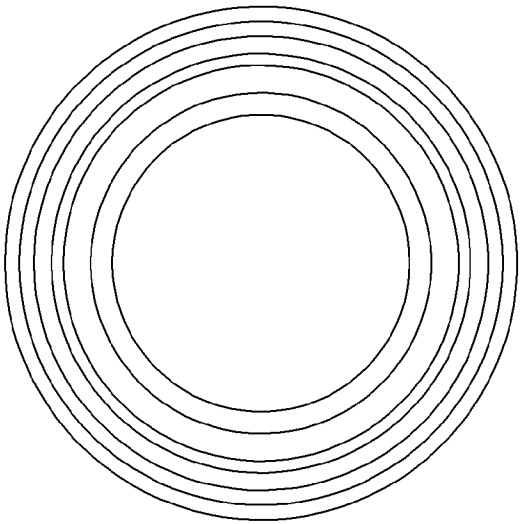
Figure 15C:
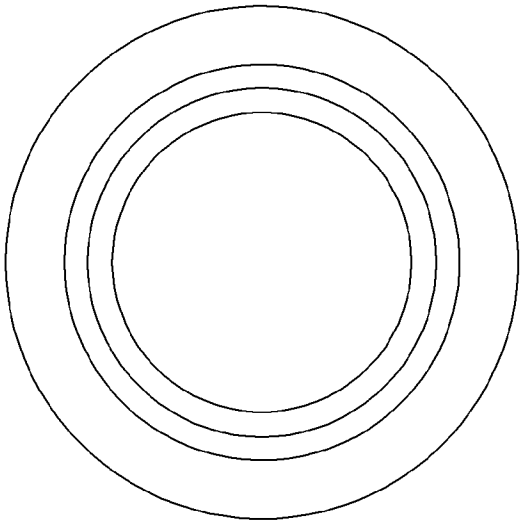
Figure 16B:
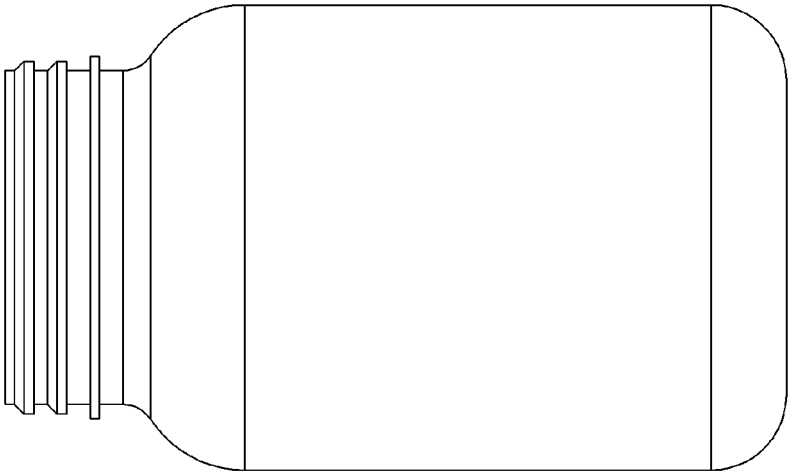
FIGS. 16A-D are a top perspective view, a side plan view, a bottom plan view, and a top plan view of an embodiment of a container body, respectively.
Figure 16A:
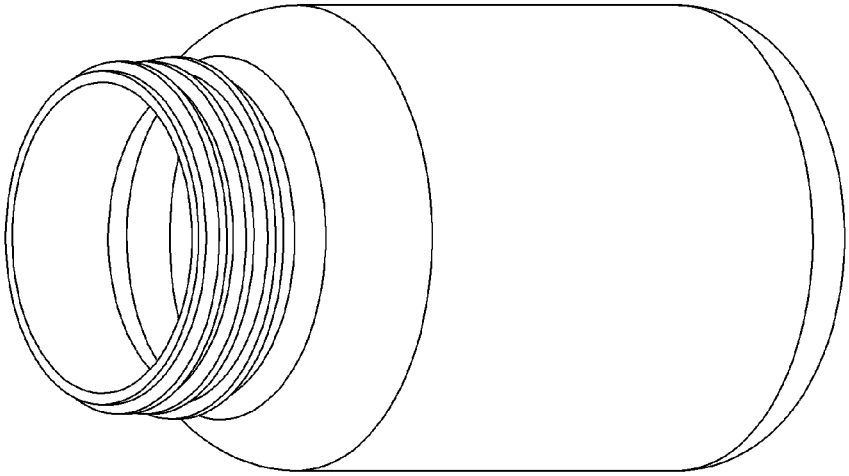
Figure 16D:
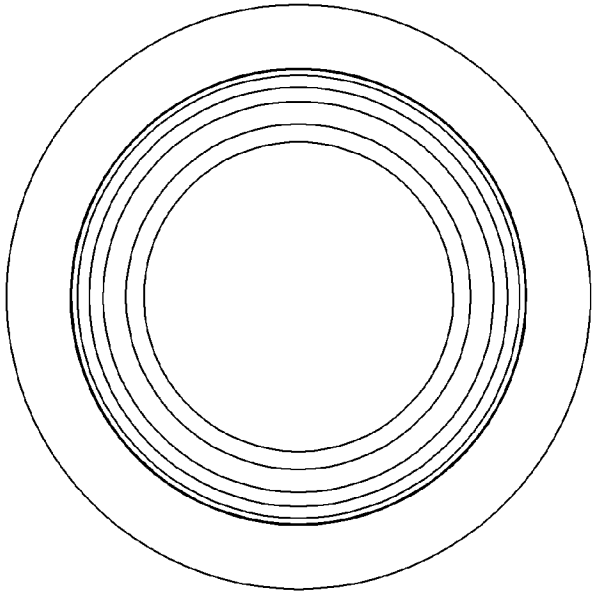
Figure 16C:
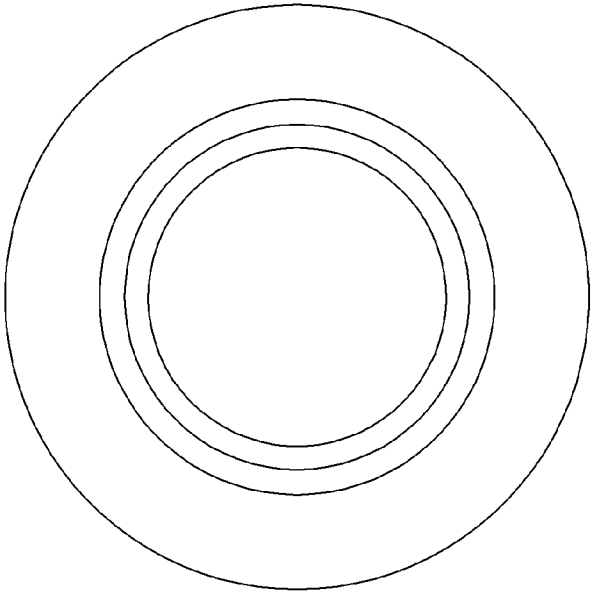
Figure 17B:
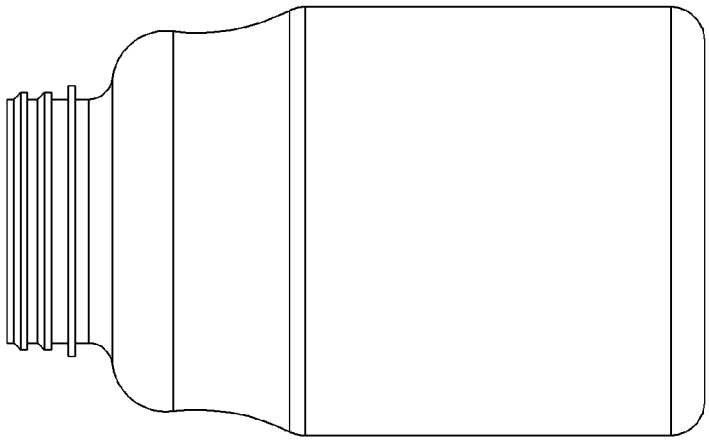
FIGS. 17A-D are a top perspective view, a side plan view, a bottom plan view, and a top plan view of an embodiment of a container body, respectively.
Figure 17A:
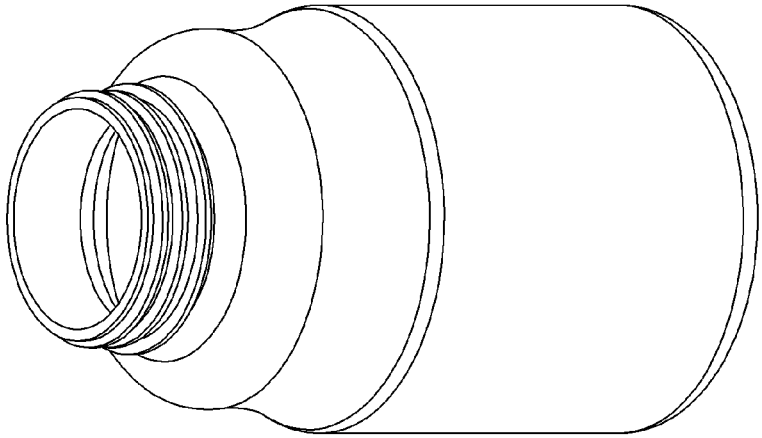
Figure 17D:
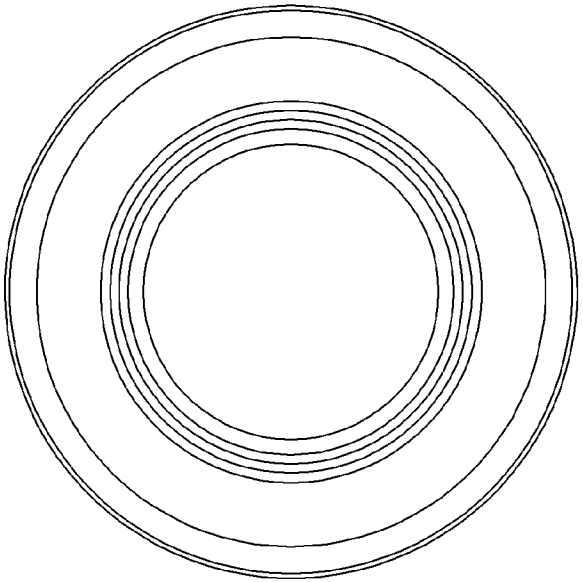
Figure 17C:
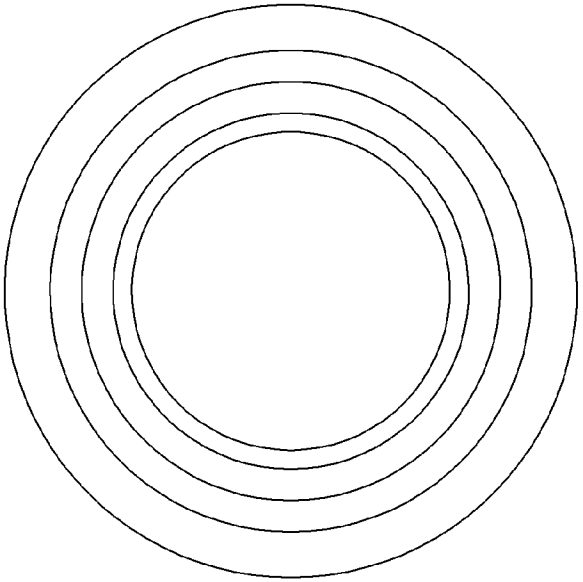
Figure 18B:
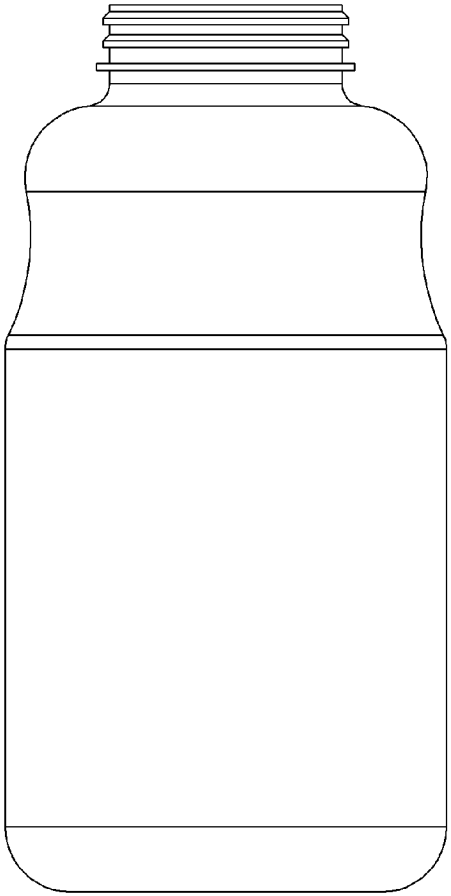
FIGS. 18A-D are a top perspective view, a side plan view, a bottom plan view, and a top plan view of an embodiment of a container body, respectively.
Figure 18A:
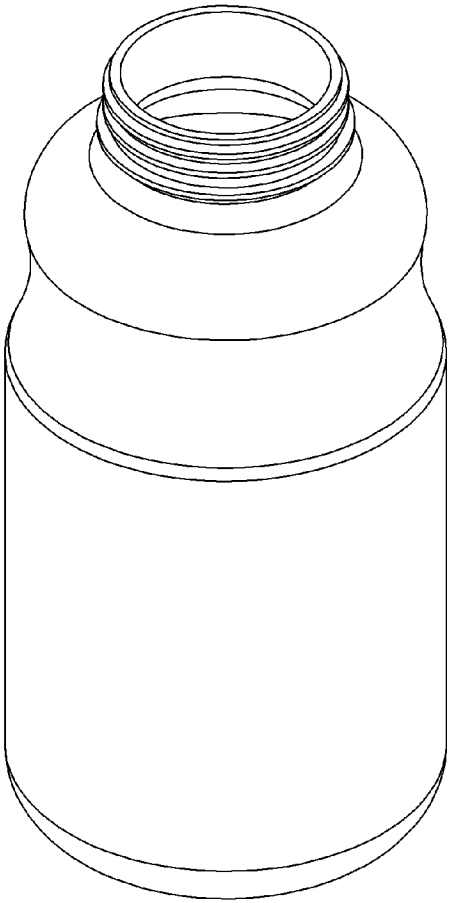
Figure 18D:
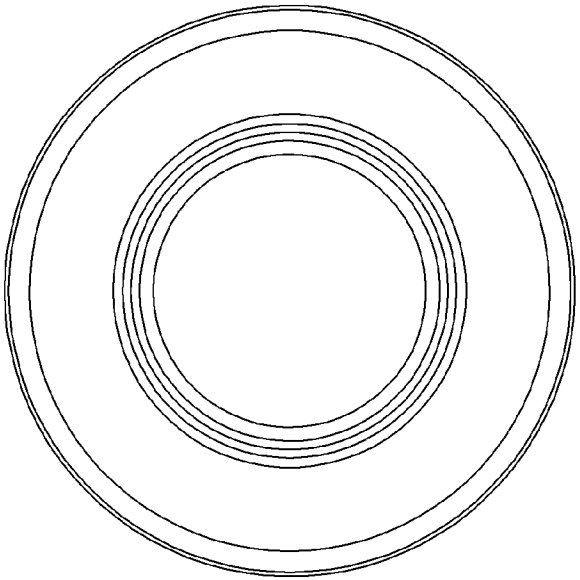
Figure 18C:
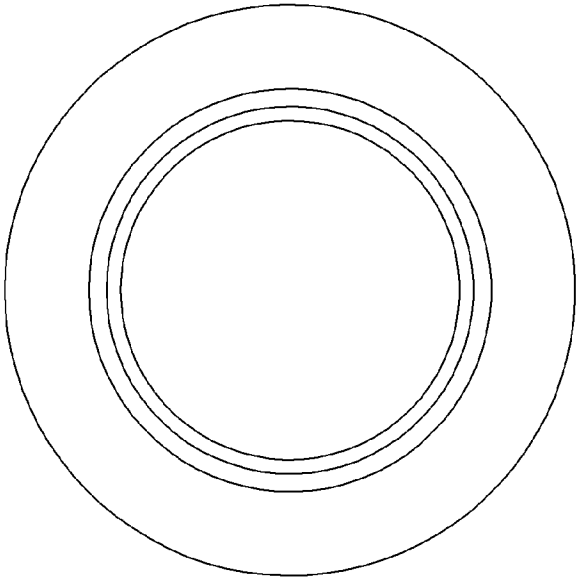
Figure 19C:
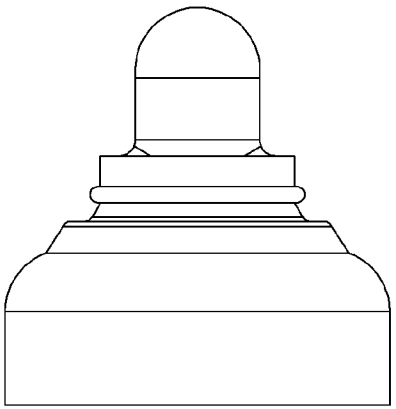
FIGS. 19A-E are a top perspective view, a side plan view, a front plan view, a bottom plan view, and a top plan view of an embodiment of a cap without an attached cover or cover connector, respectively.
Figure 19B:
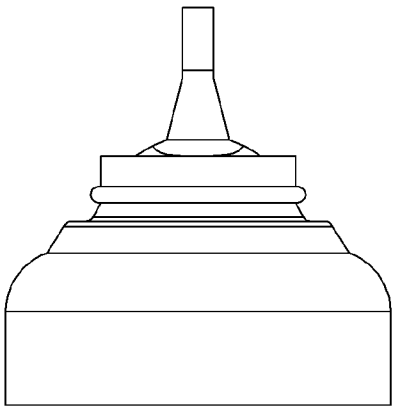
Figure 19A:
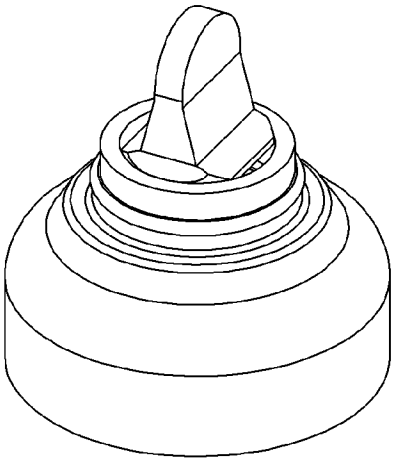
Figure 19E:
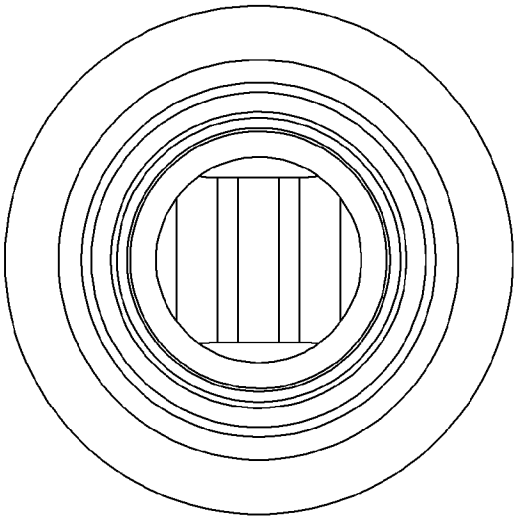
Figure 19D:
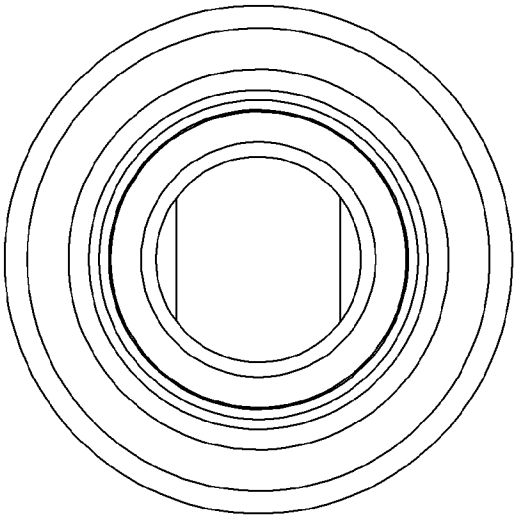
Figure 20C:
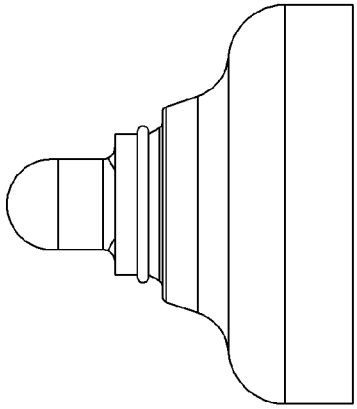
FIGS. 20A-E are a top perspective view, a side plan view, a front plan view, a bottom plan view, and a top plan view of an embodiment of a cap without an attached cover or cover connector, respectively.
Figure 20B:
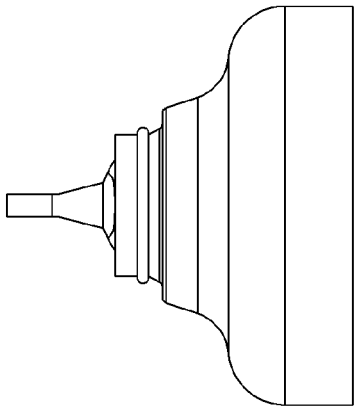
Figure 20A:
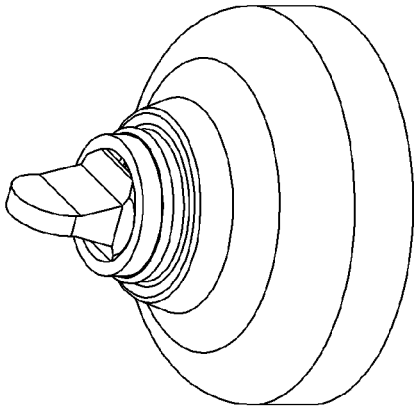
Figure 20E:
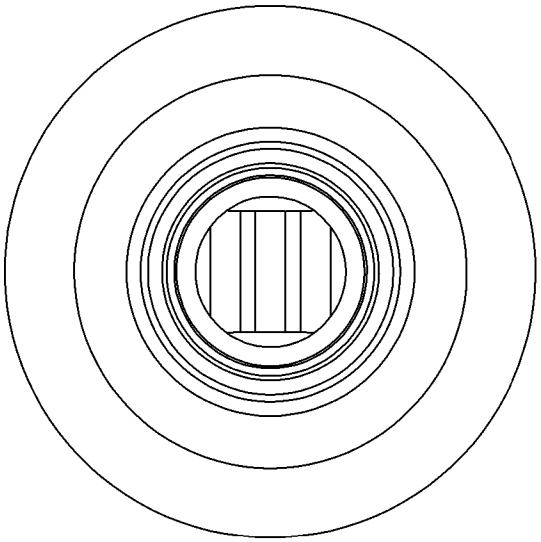
Figure 20D:
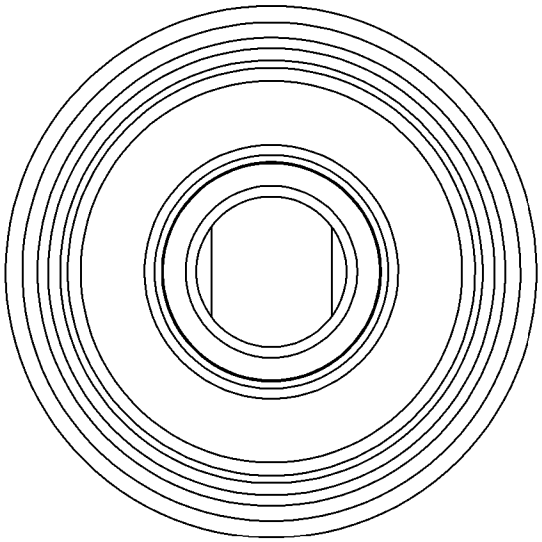
Figure 21C:
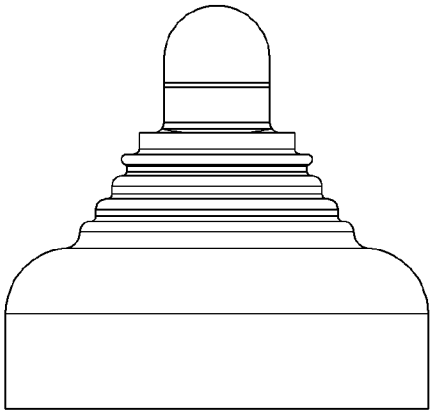
FIGS. 21A-E are a top perspective view, a side plan view, a front plan view, a bottom plan view, and a top plan view of an embodiment of a cap without an attached cover or cover connector, respectively.
Figure 21B:
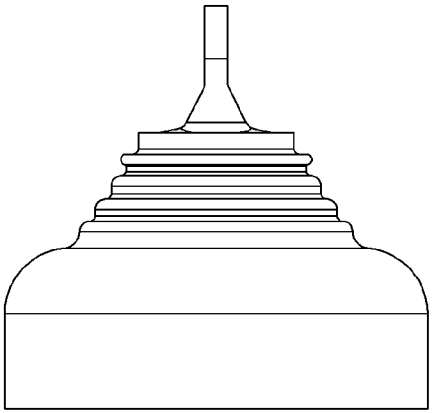
Figure 21A:
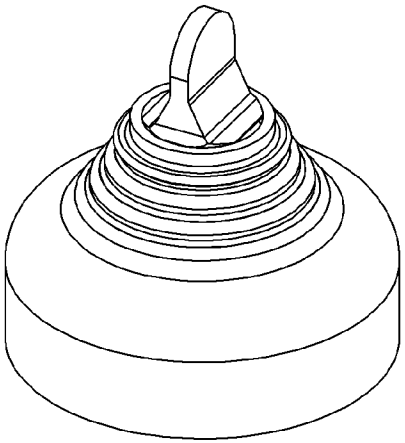
Figure 21E:
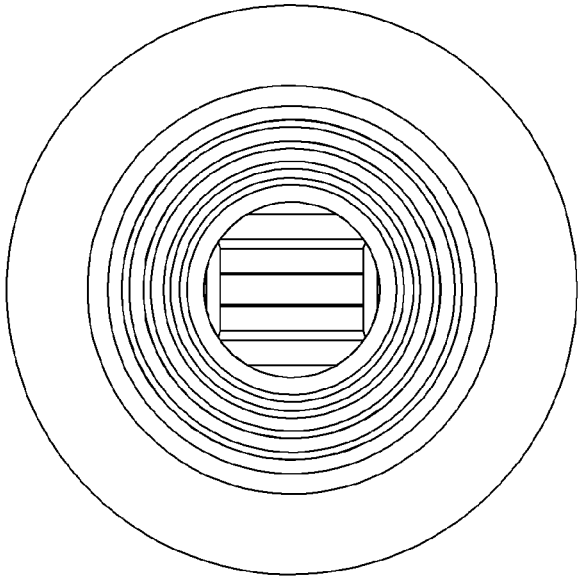
Figure 21D:
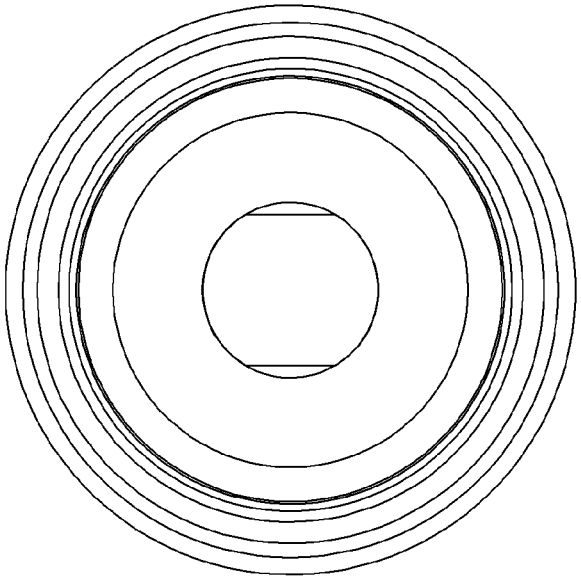
Figure 22A:
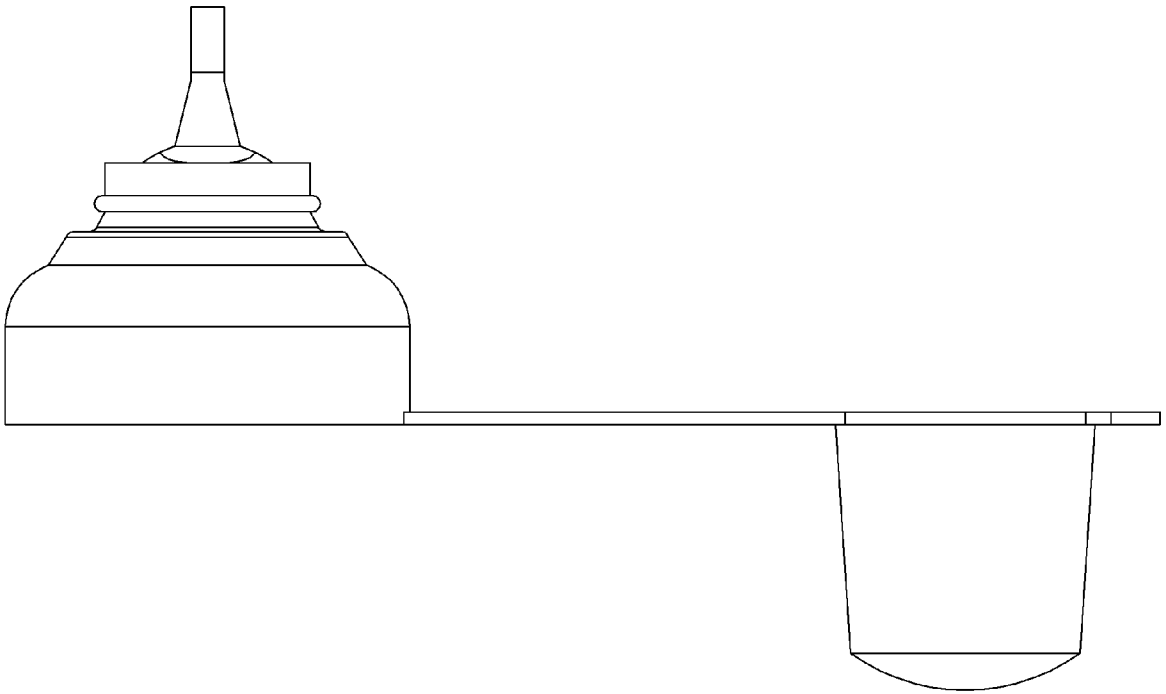
FIGS. 22A-G are a right side plan view, a left side plan view, a front plan view, a back plan view, a bottom plan view, a top plan view, and a top perspective view of an embodiment of a cap with an attached cover and cover connector with the cover in a disengaged position, respectively.
Figure 22B:
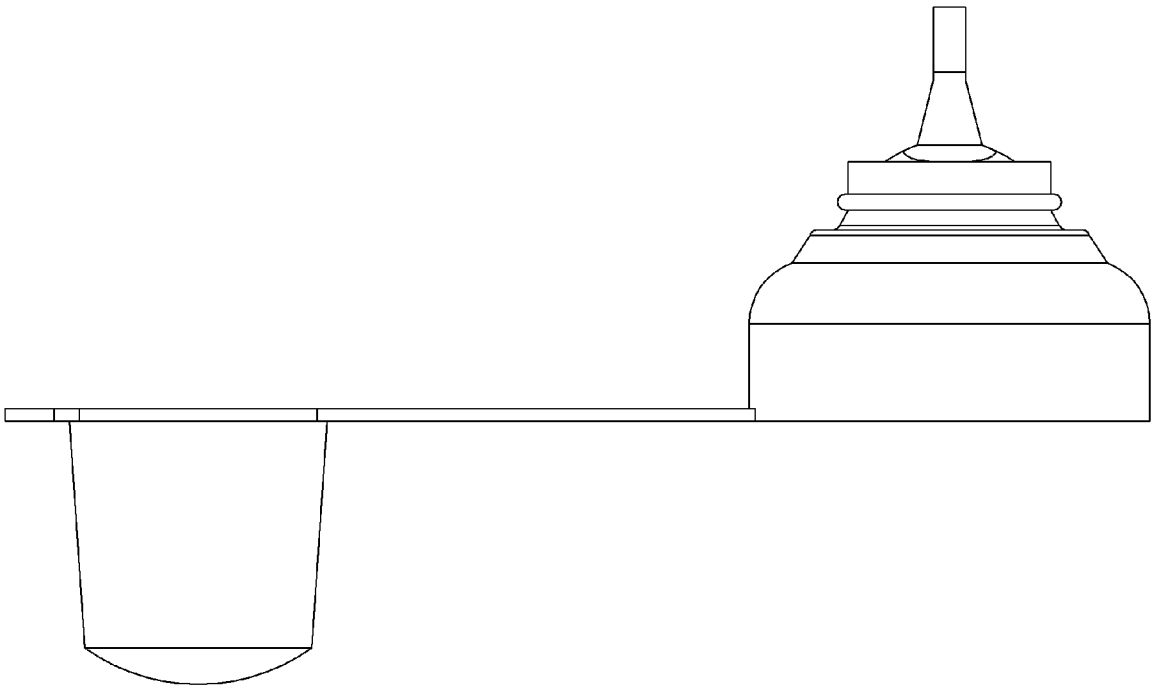
Figure 22C:
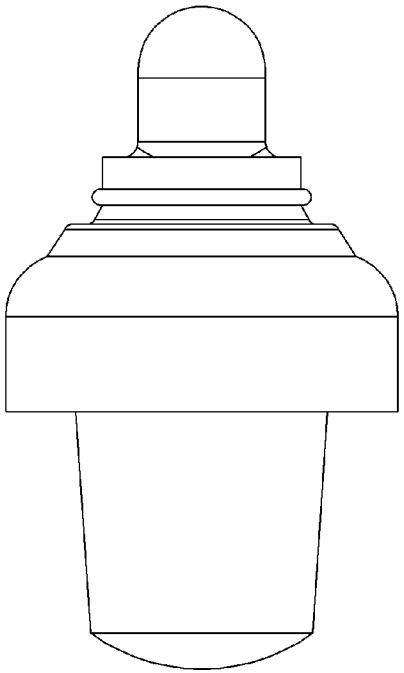
Figure 22D:
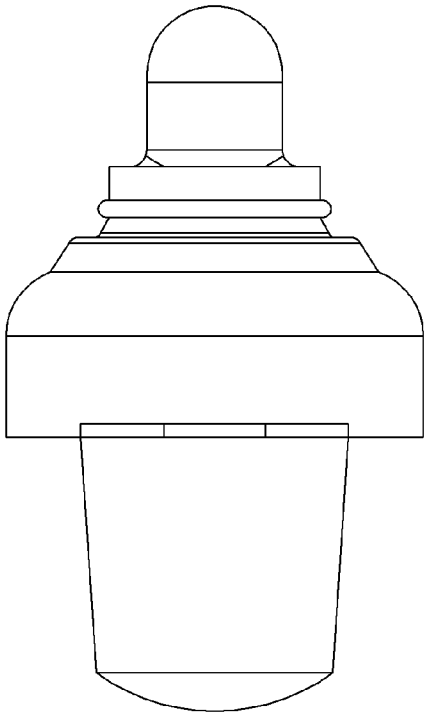
Figure 22E:
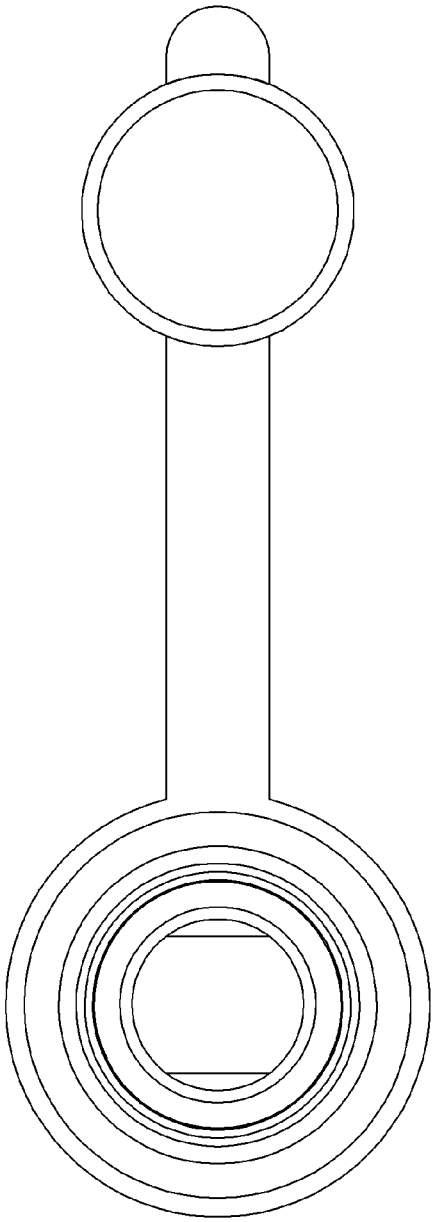
Figure 22F:
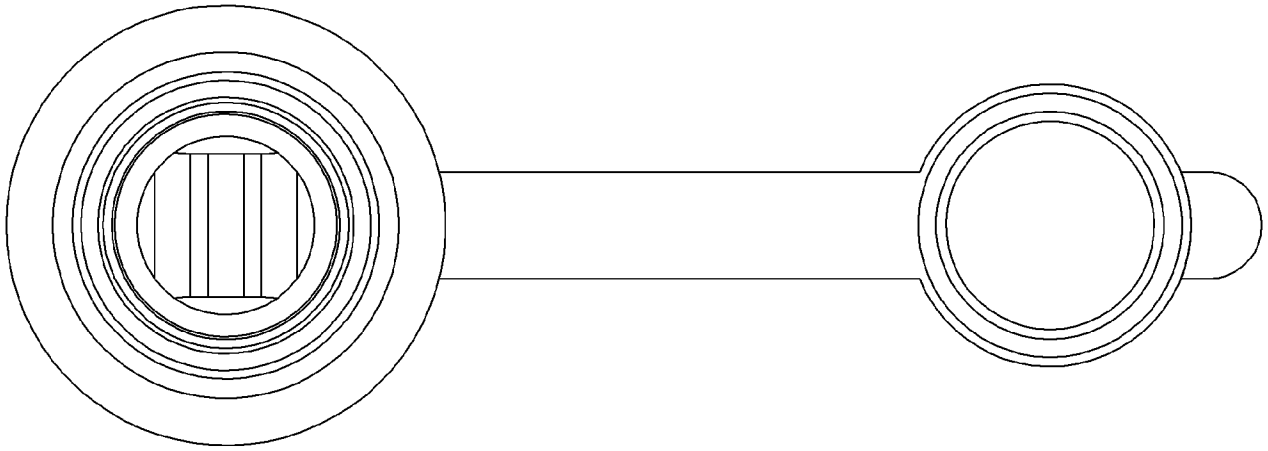
Figure 22G:
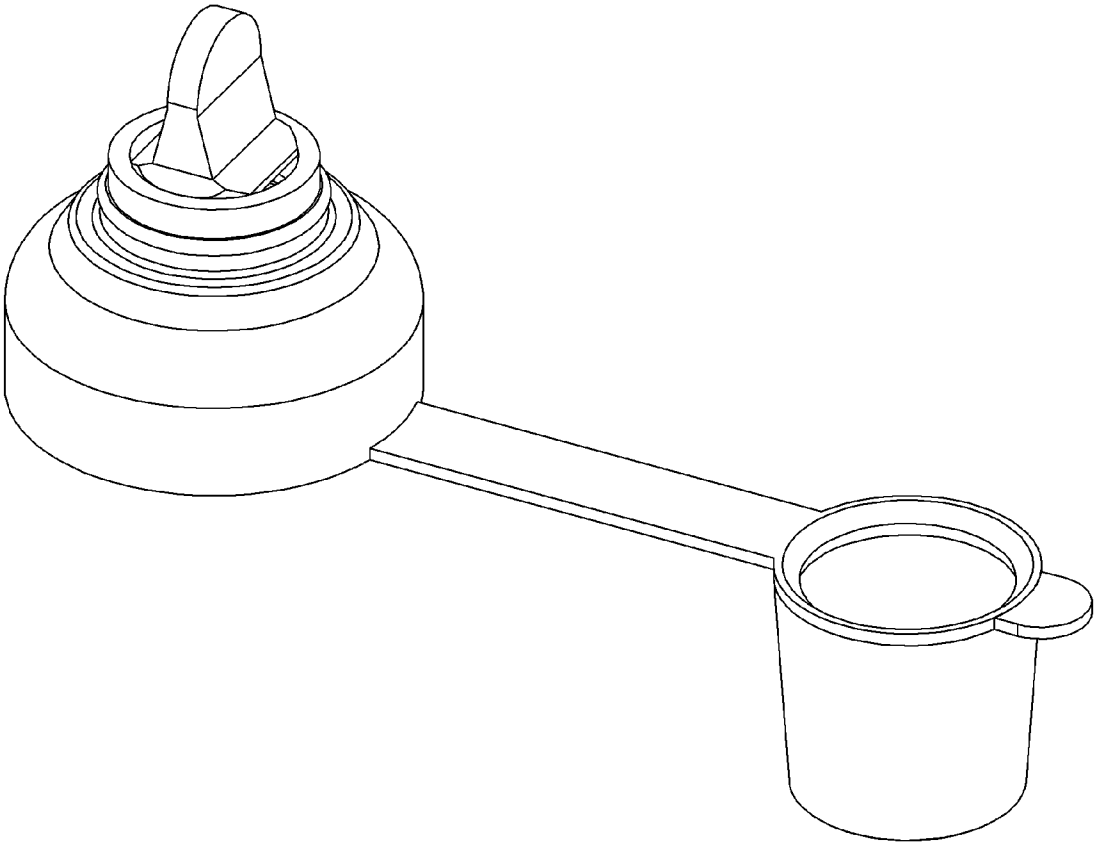
Figure 22H:
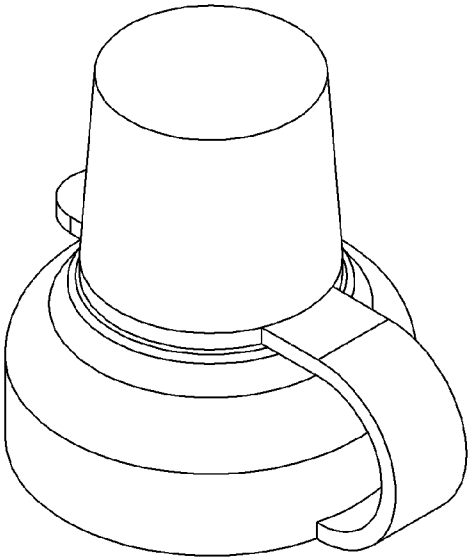
FIG. 22H is a top perspective view of an embodiment of a cap with an attached cover and cover connector with the cover in an engaged position.
Figure 23A:
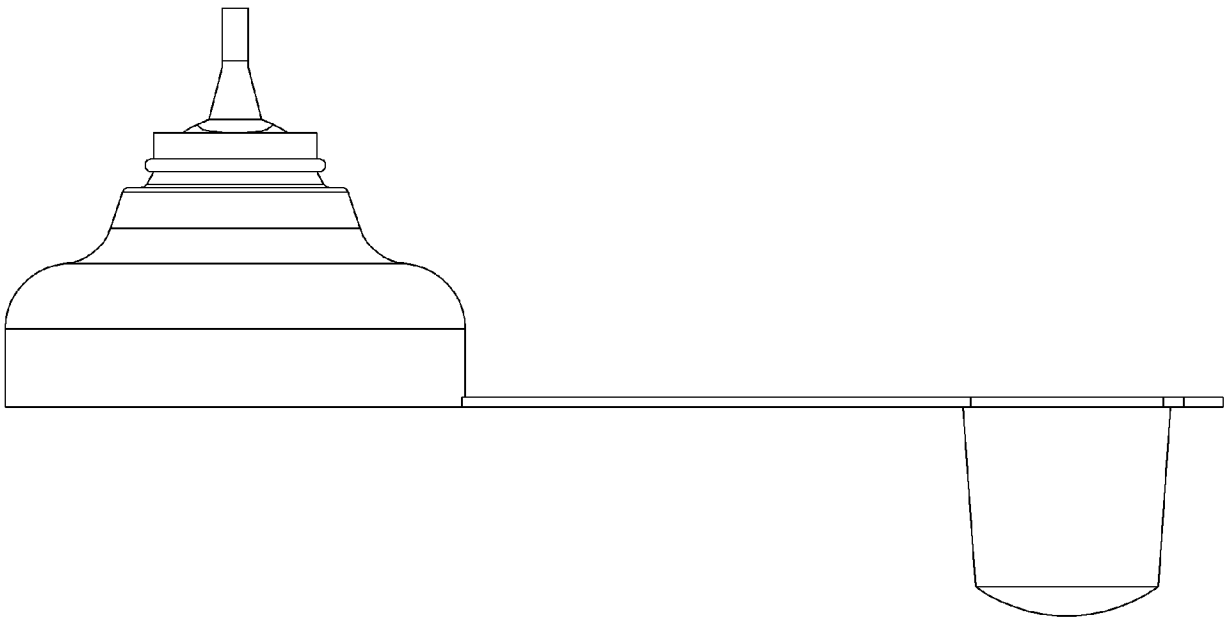
FIGS. 23A-G are a right side plan view, a left side plan view, a front plan view, a back plan view, a bottom plan view, a top plan view, and a top perspective view of an embodiment of a cap with an attached cover and cover connector with the cover in a disengaged position, respectively.
Figure 23B:
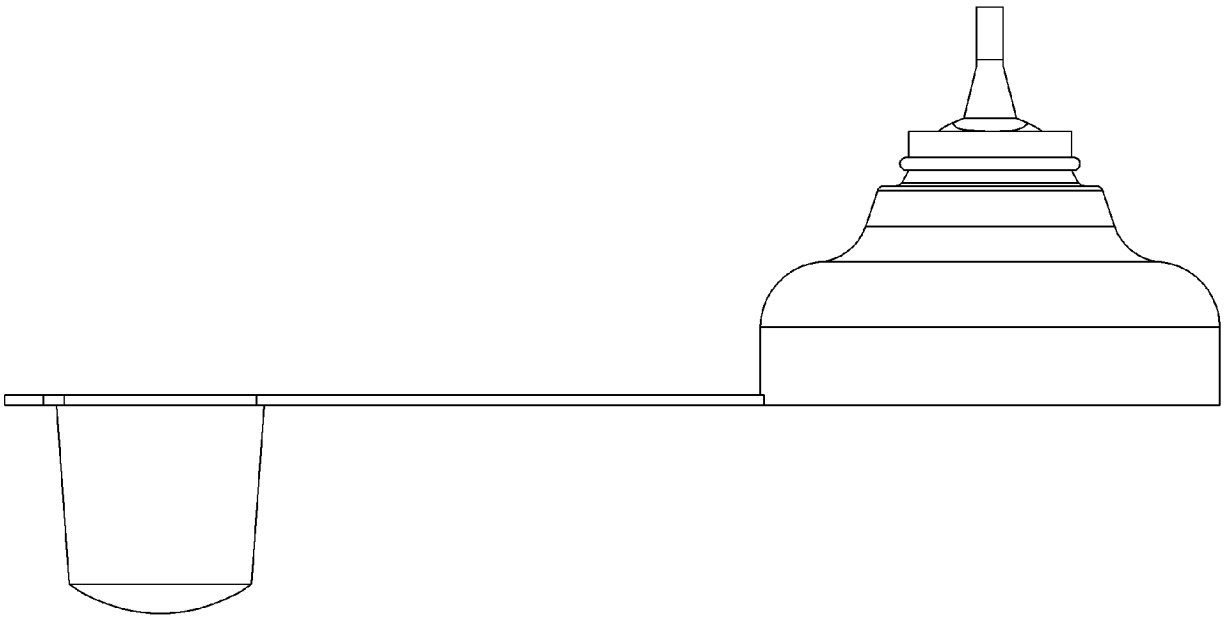
Figure 23C:
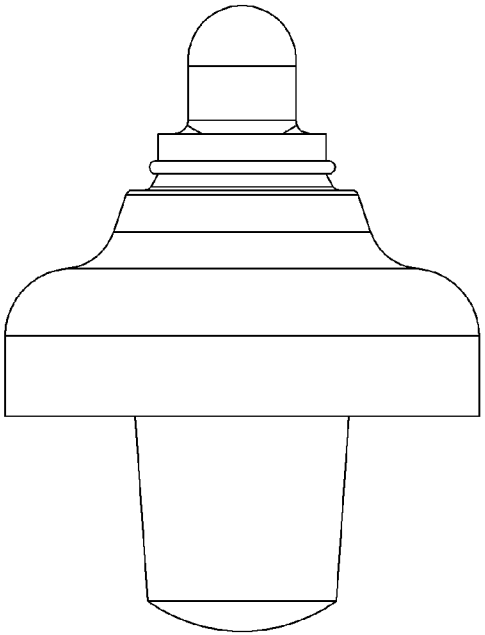
Figure 23D:
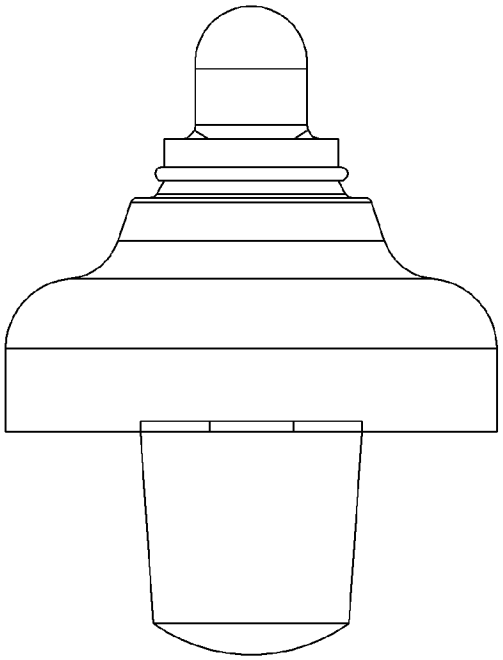
Figure 23E:
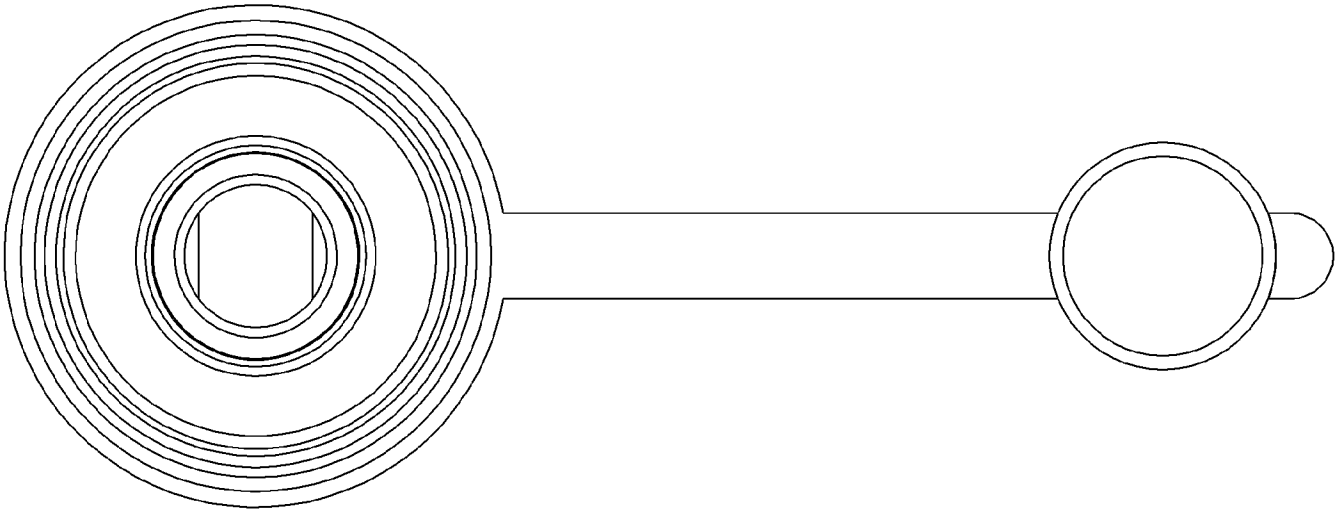
Figure 23F:
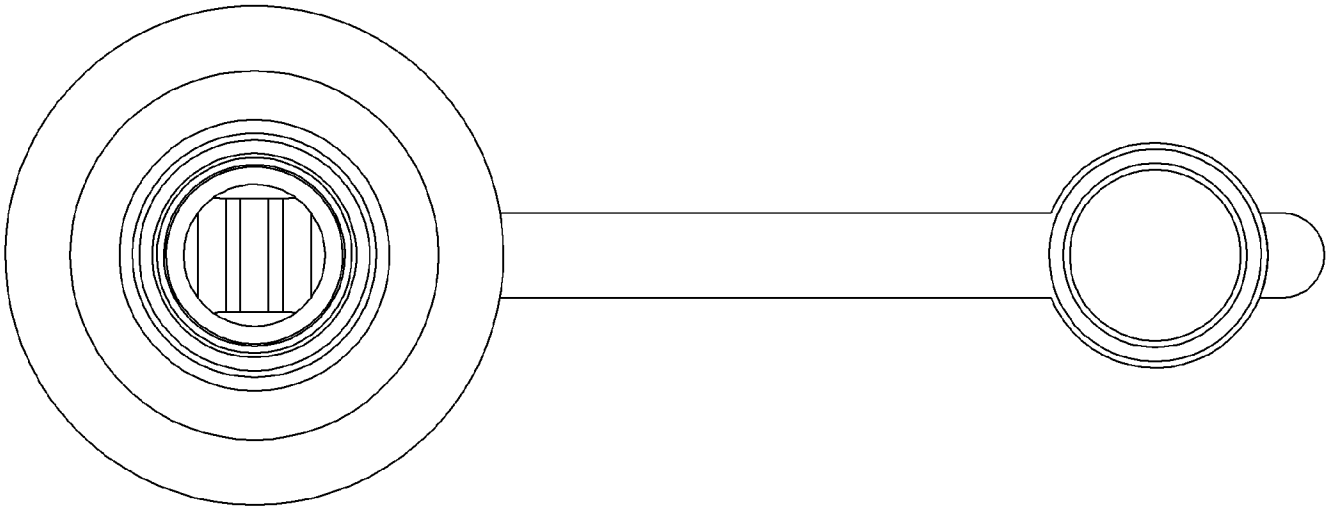
Figure 23G:
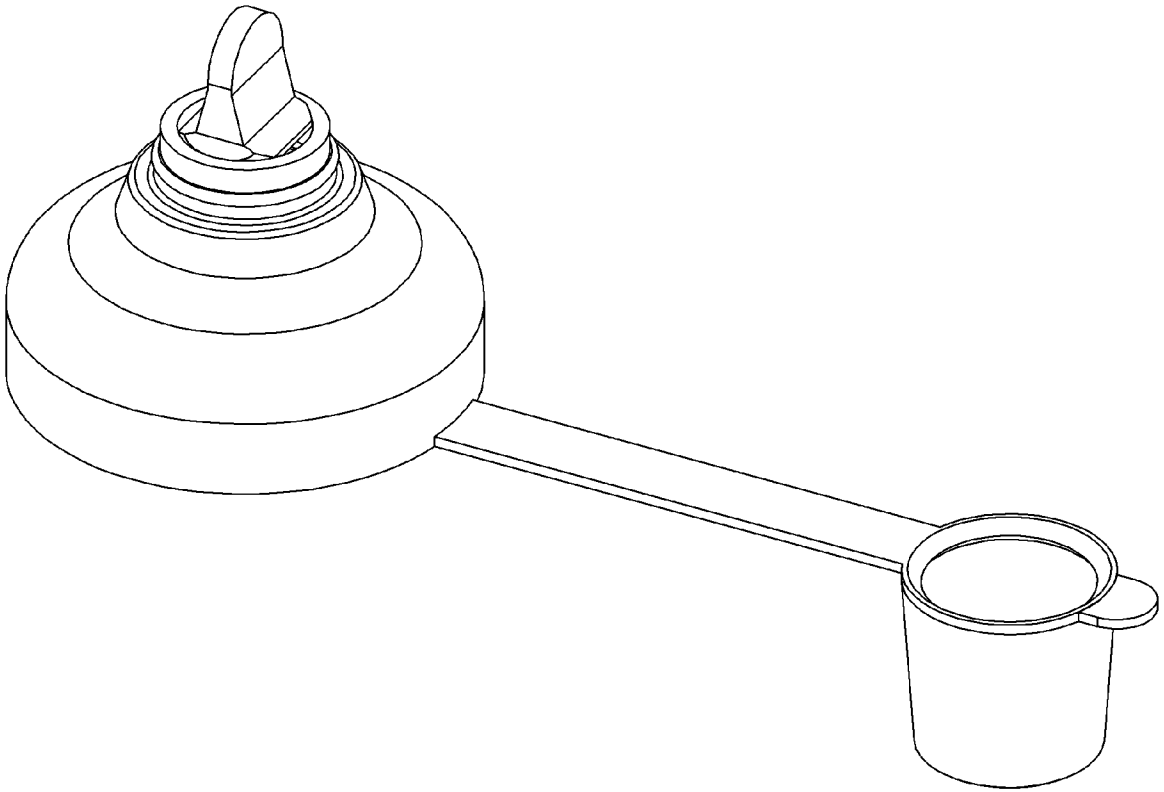
Figure 23H:
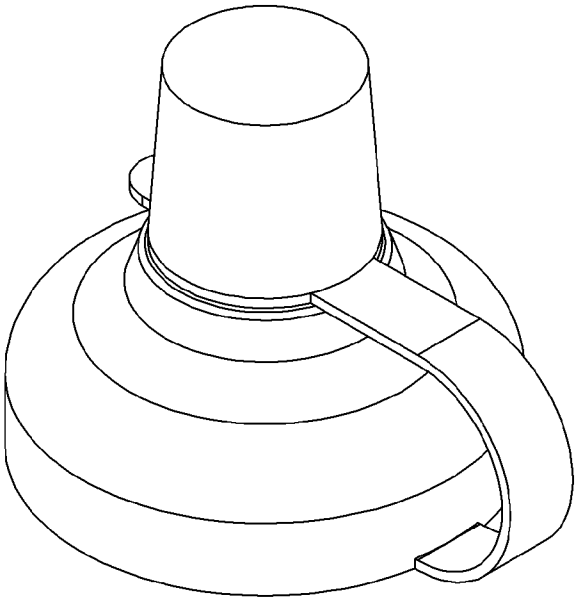
FIG. 23H is a top perspective view of an embodiment of a cap with an attached cover and cover connector with the cover in an engaged position.
Figure 24A:
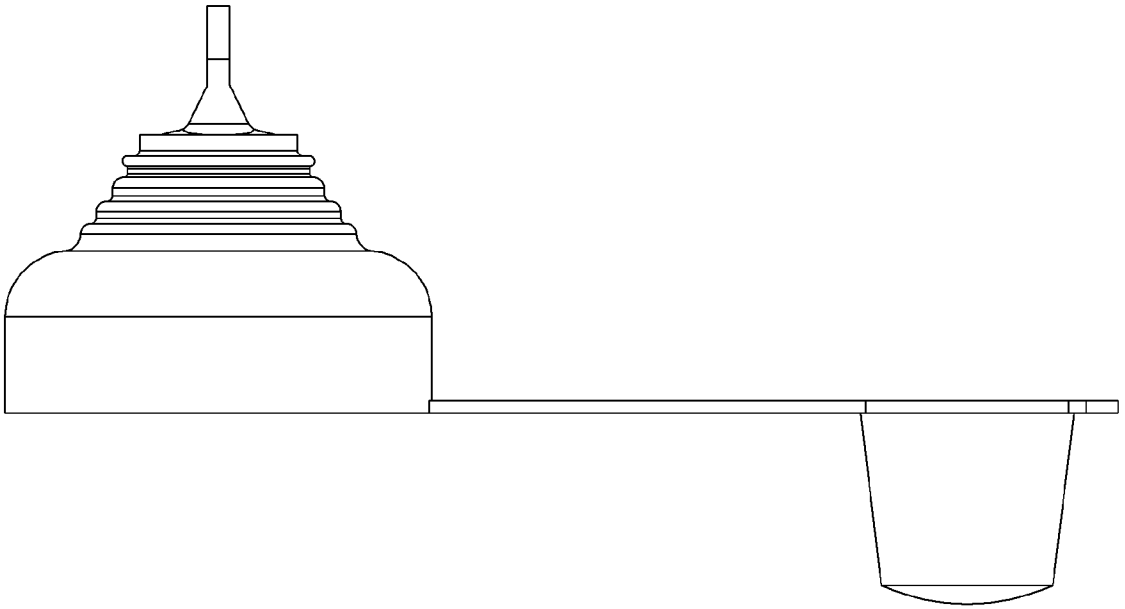
FIGS. 24A-G are a right side plan view, a left side plan view, a front plan view, a back plan view, a bottom plan view, a top plan view, and a top perspective view of an embodiment of a cap with an attached cover and cover connector with the cover in a disengaged position, respectively.
Figure 24B:
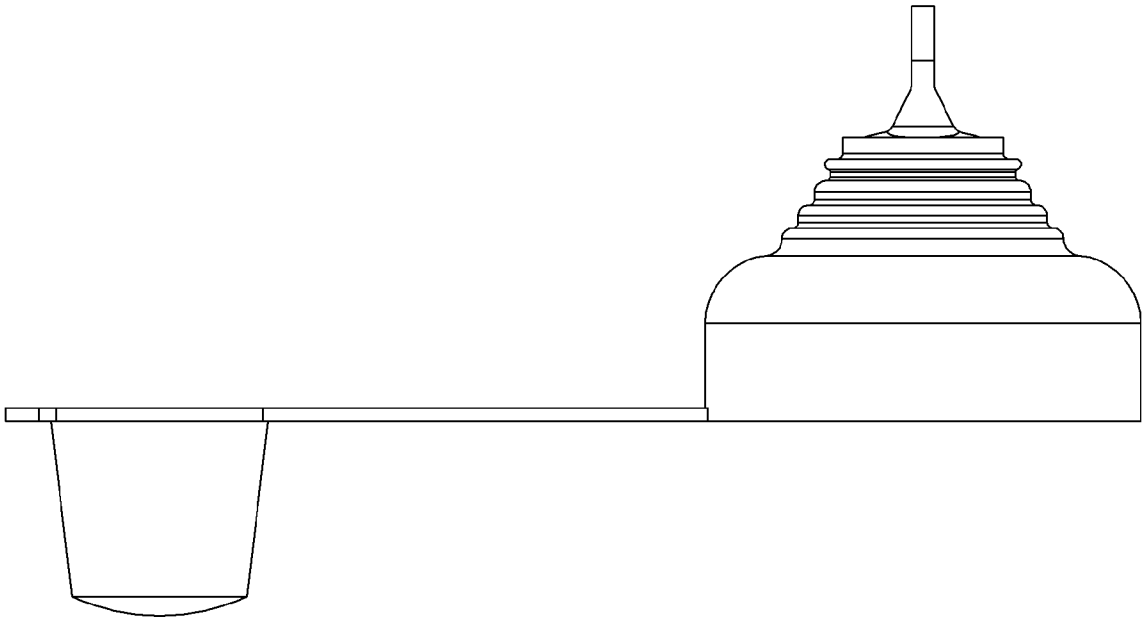
Figure 24C:
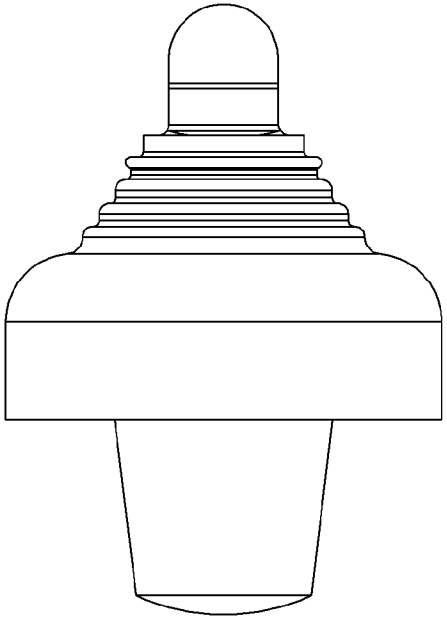
Figure 24D:
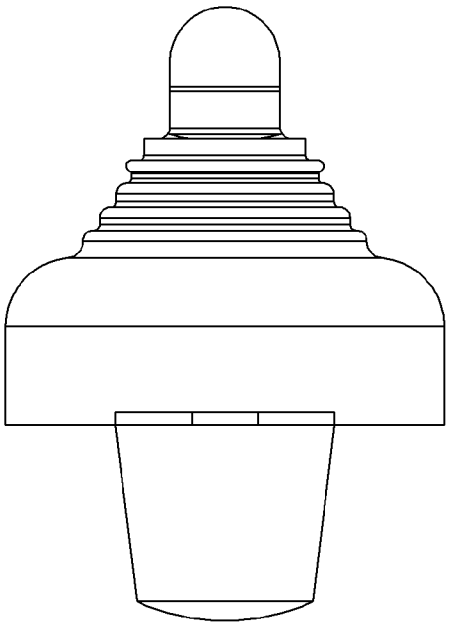
Figure 24E:
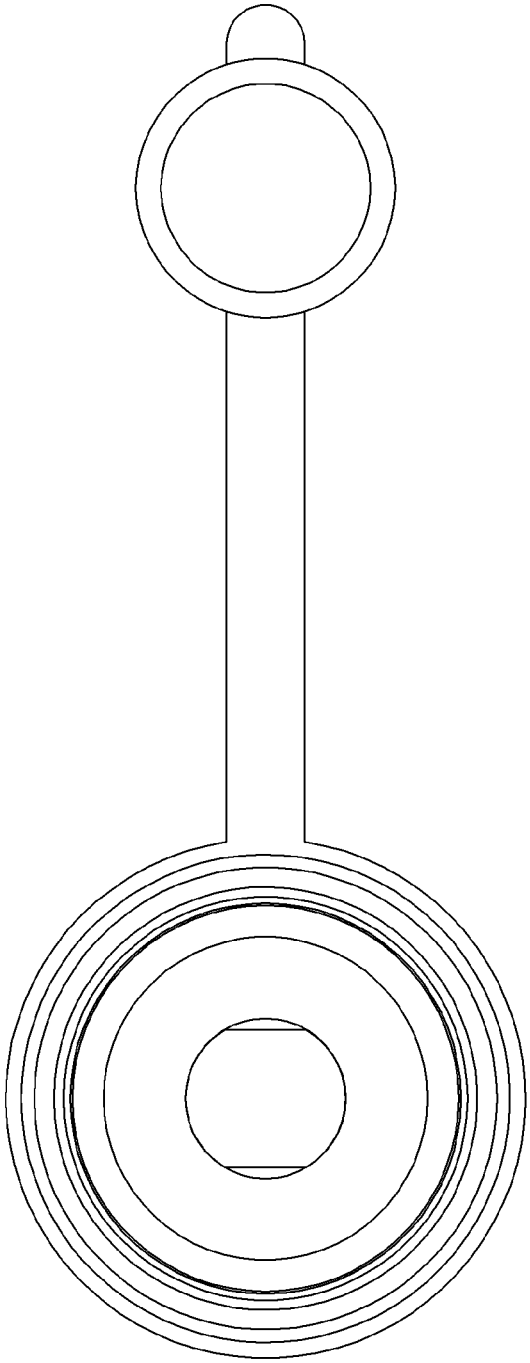
Figure 24F:
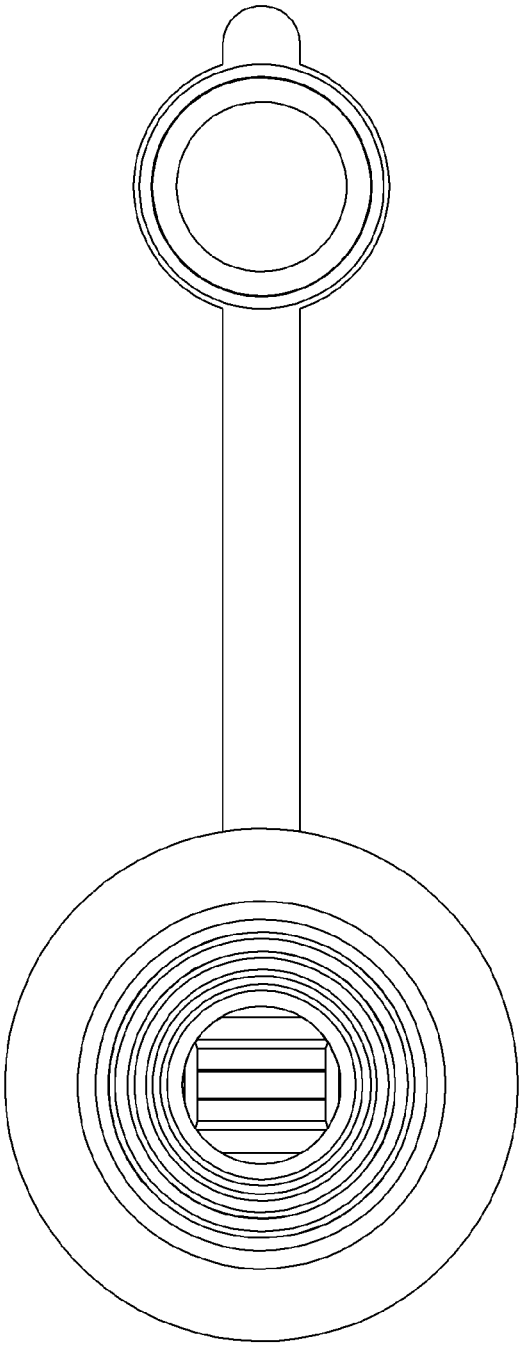
Figure 24G:
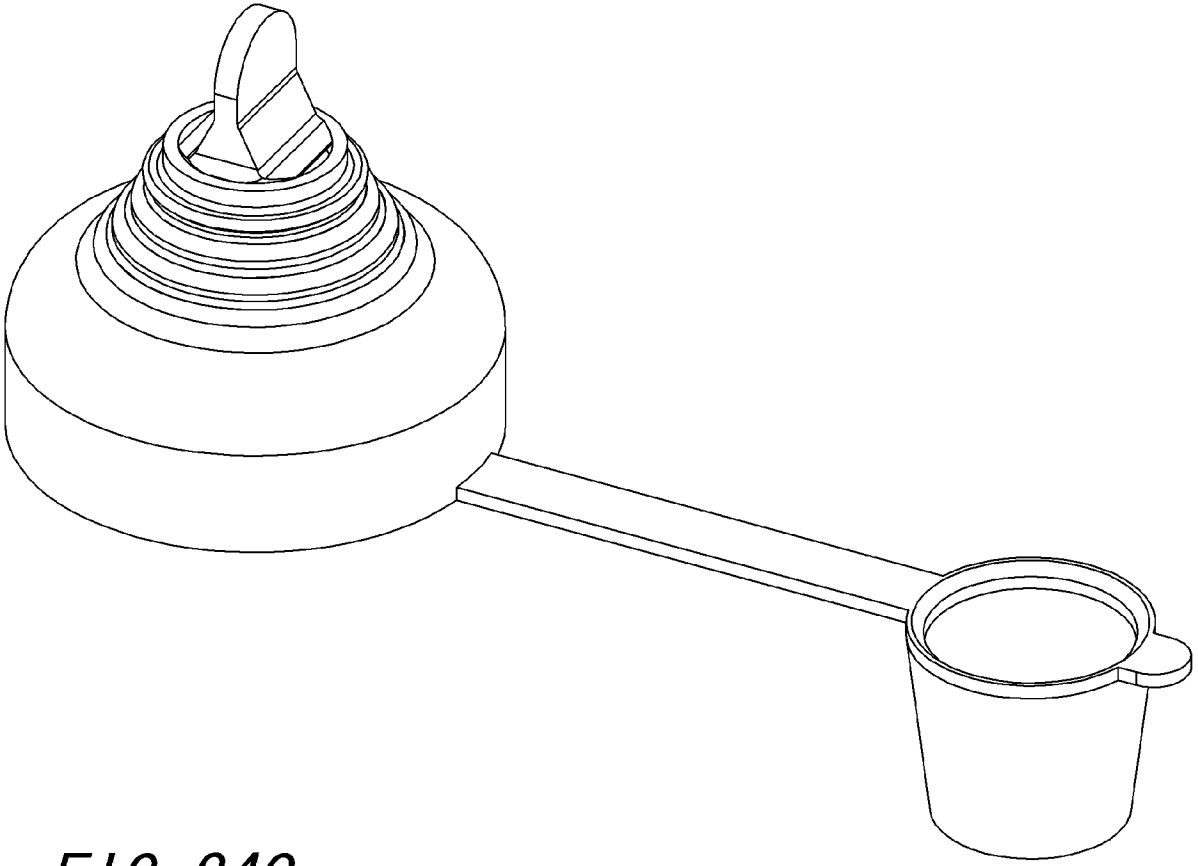
Figure 24H:
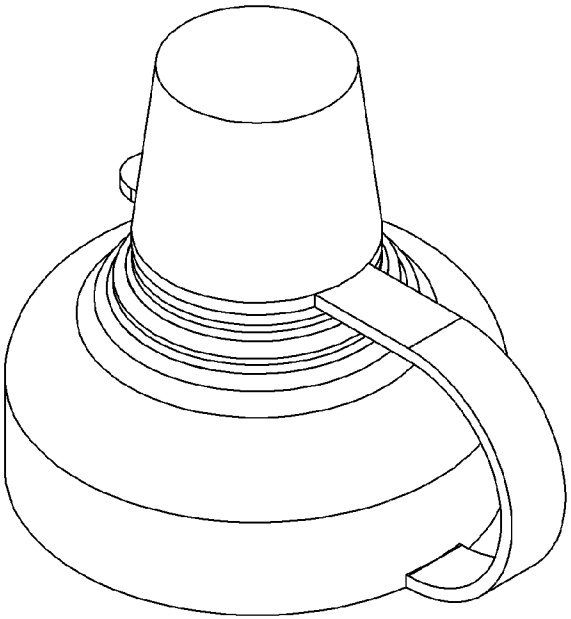
FIG. 24H is a top perspective view of an embodiment of a cap with an attached cover and cover connector with the cover in an engaged position.
Figure 25A:
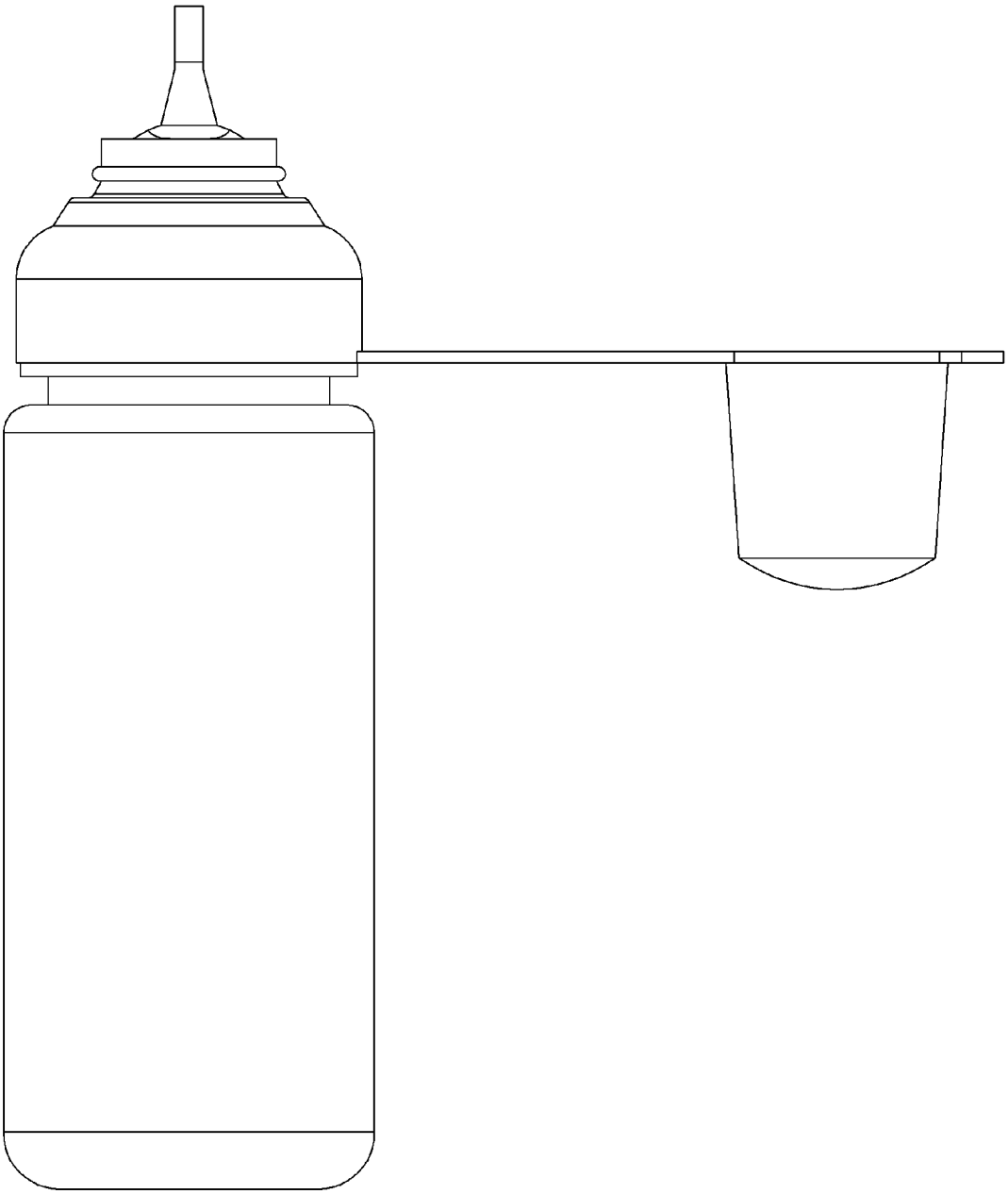
FIGS. 25A-G are a right side plan view, a left side plan view, a back plan view, a front plan view, a bottom plan view, a top plan view, and a top perspective view of an embodiment of a container body engaged with a cap with an attached cover and cover connector and the cover in a disengaged position, respectively.
Figure 25B:
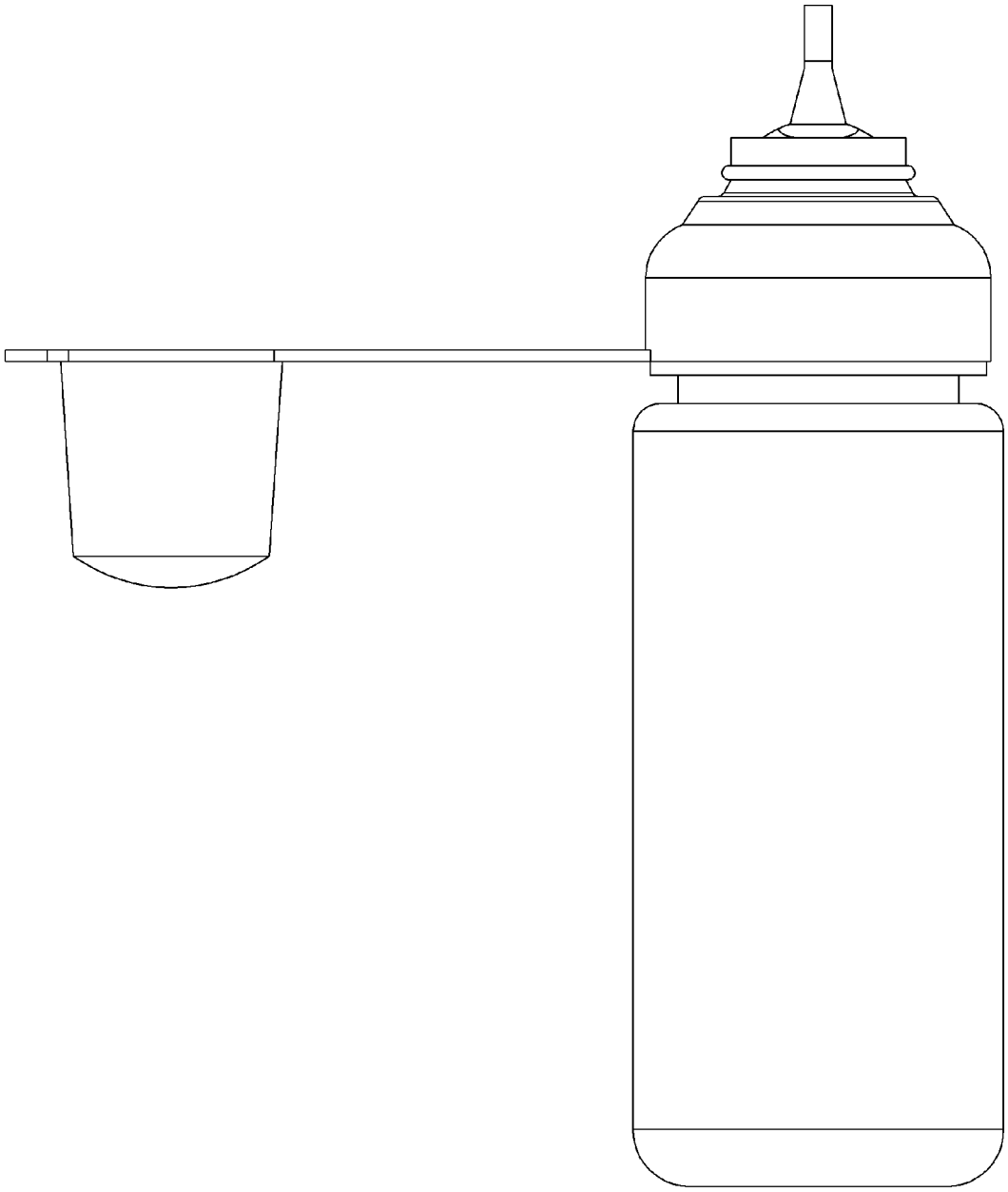
Figure 25C:
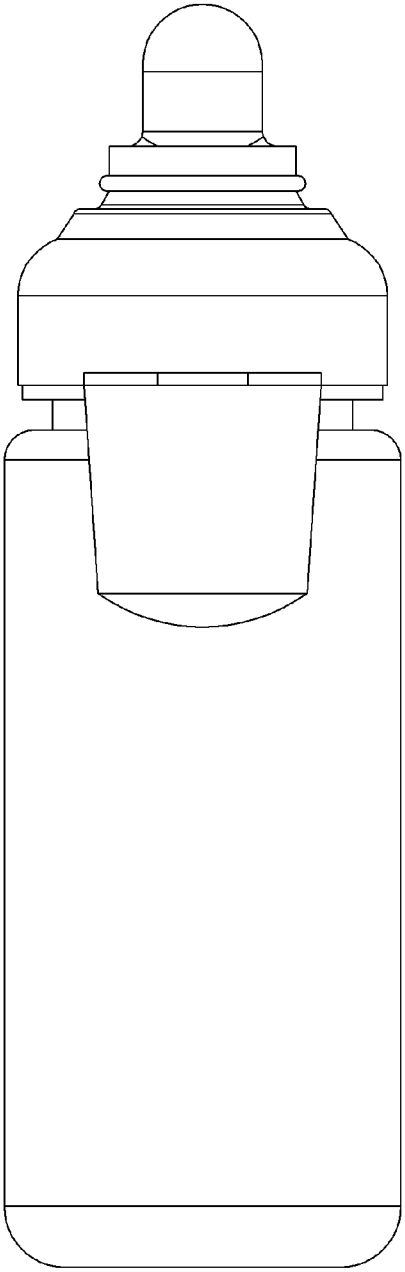
Figure 25D:
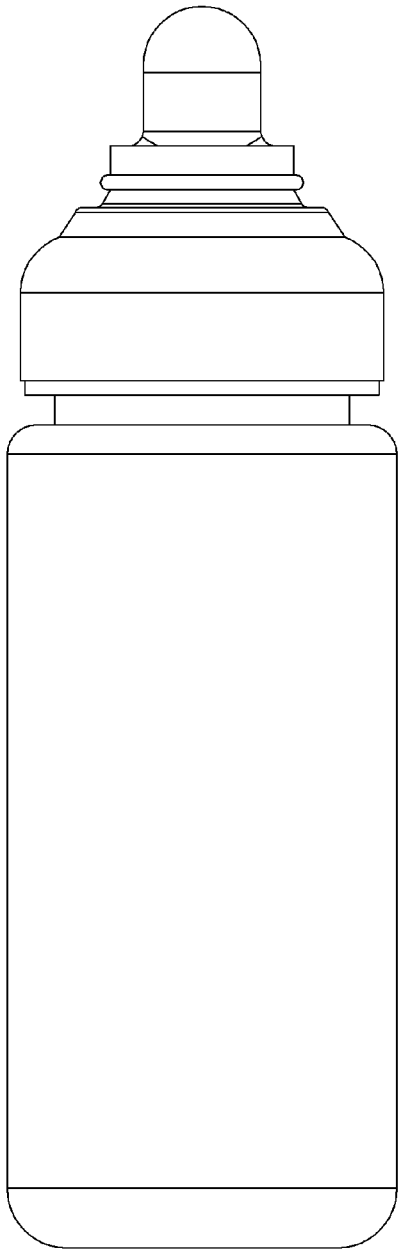
Figure 25E:
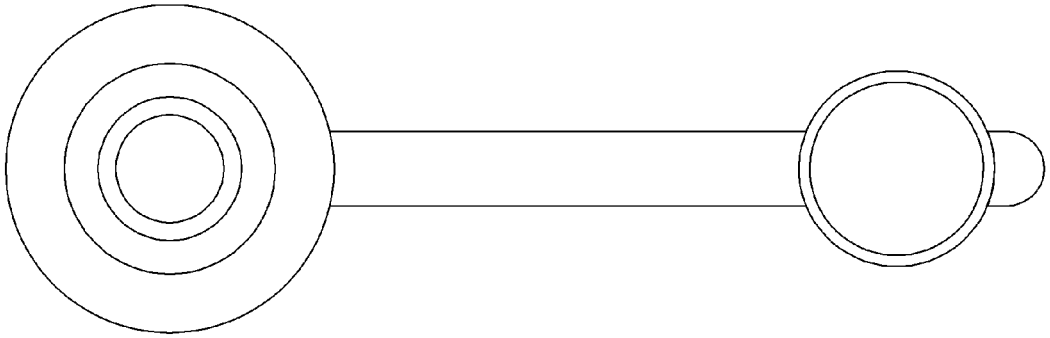
Figure 25F:
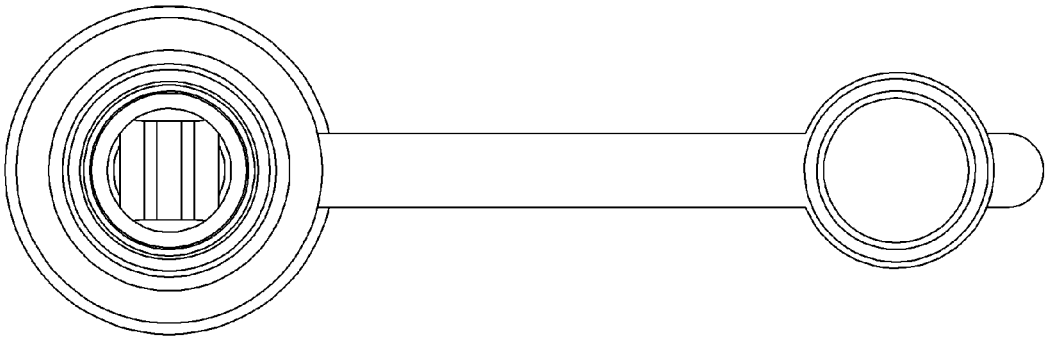
Figure 25G:
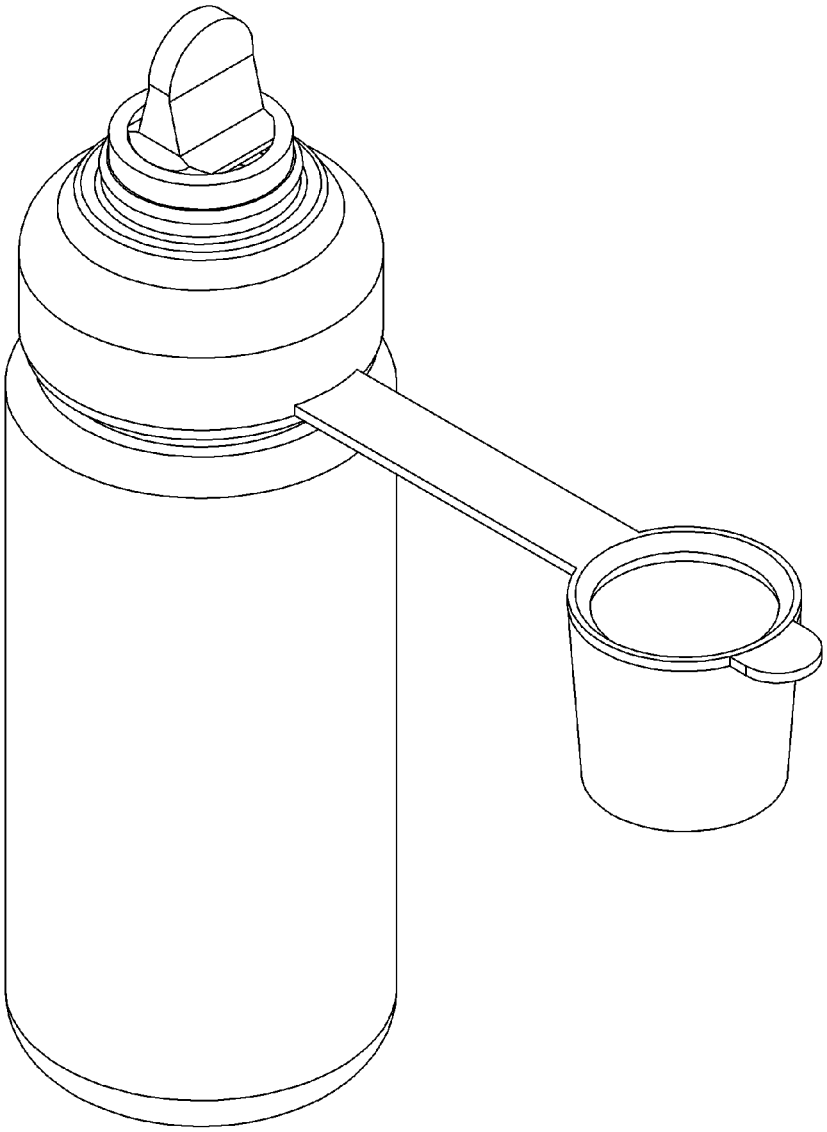
Figure 26A:
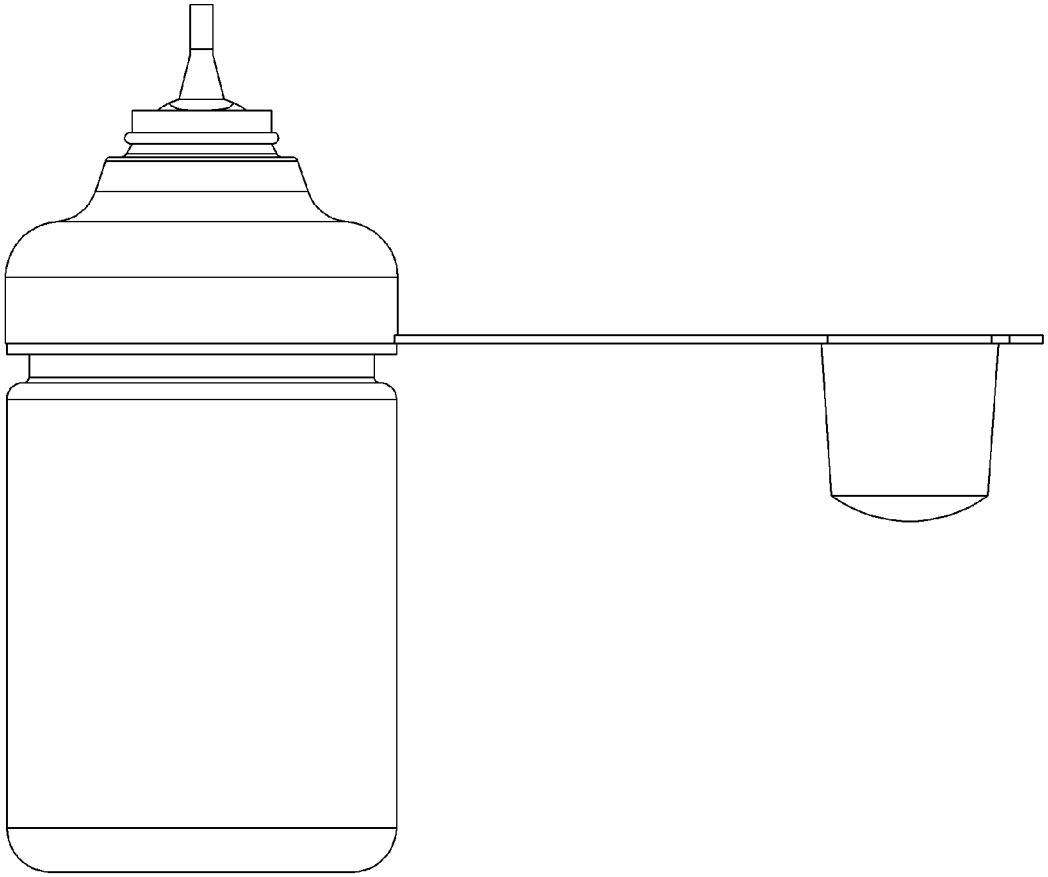
FIGS. 26A-G are a right side plan view, a left side plan view, a back plan view, a front plan view, a bottom plan view, a top plan view, and a top perspective view of an embodiment of a container body engaged with a cap with an attached cover and cover connector and the cover in a disengaged position, respectively.
Figure 26B:
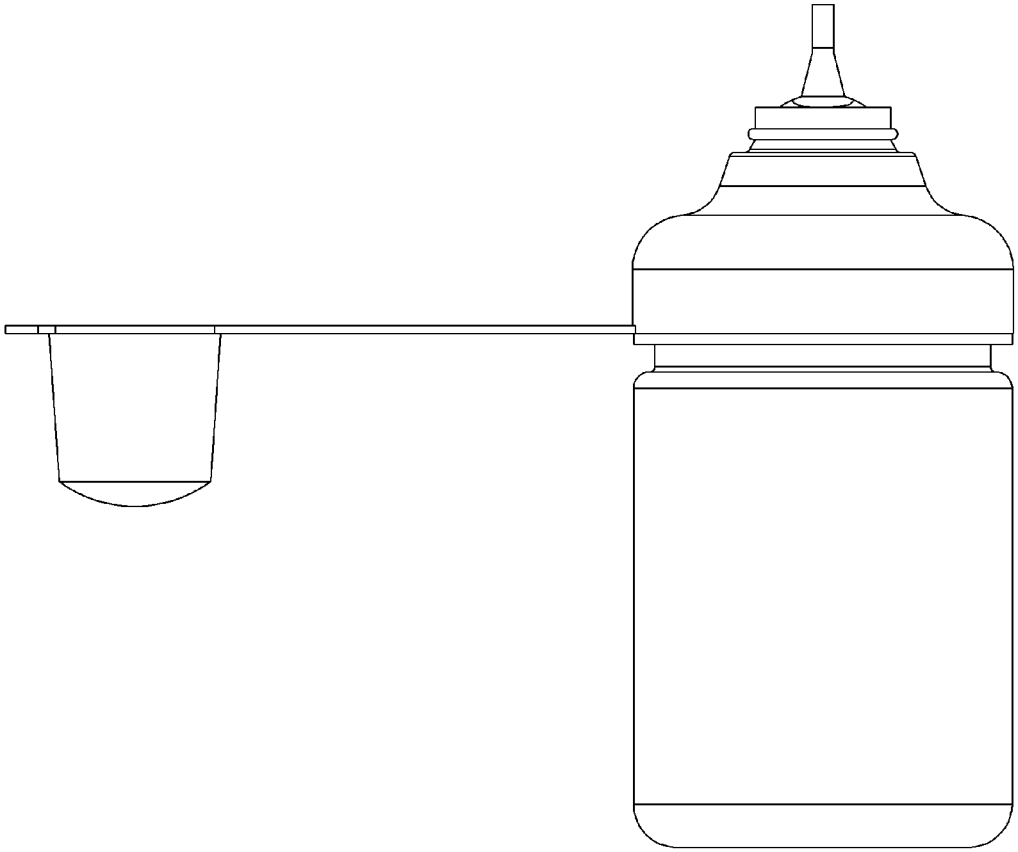
Figure 26C:
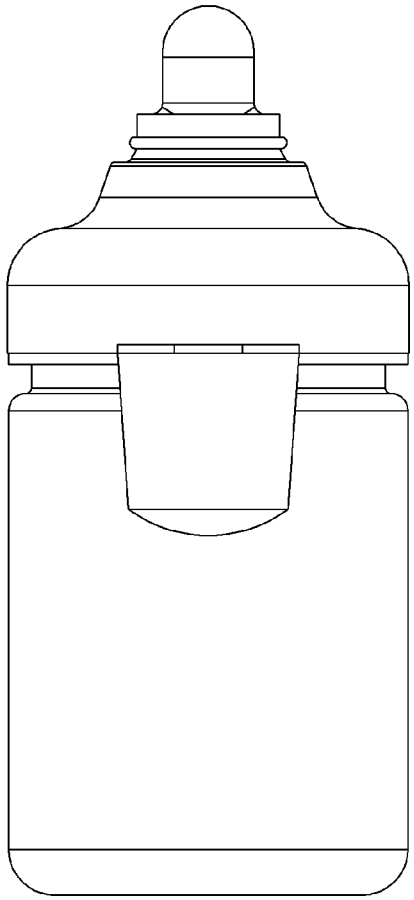
Figure 26D:
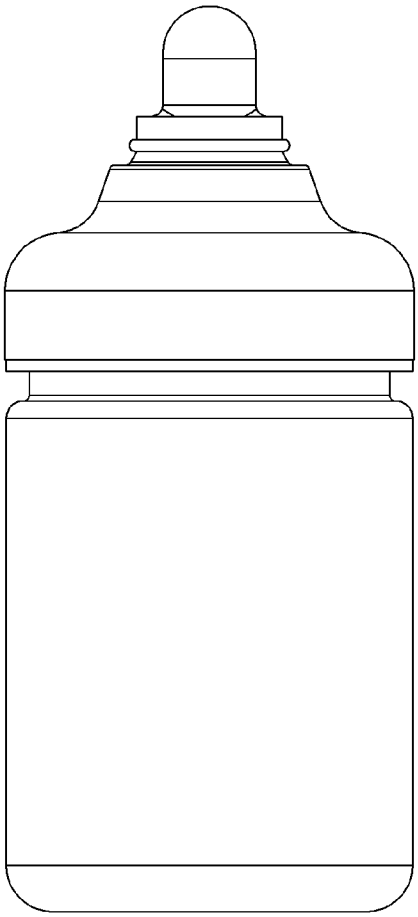
Figure 26E:
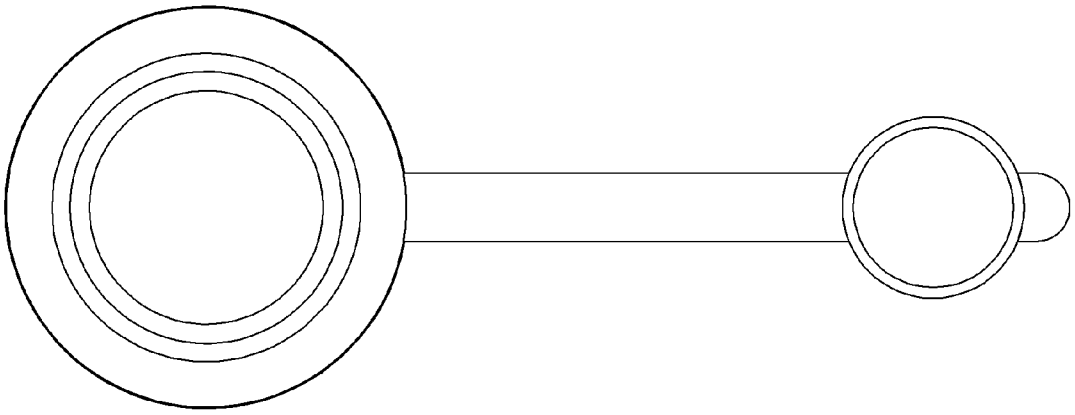
Figure 26F:
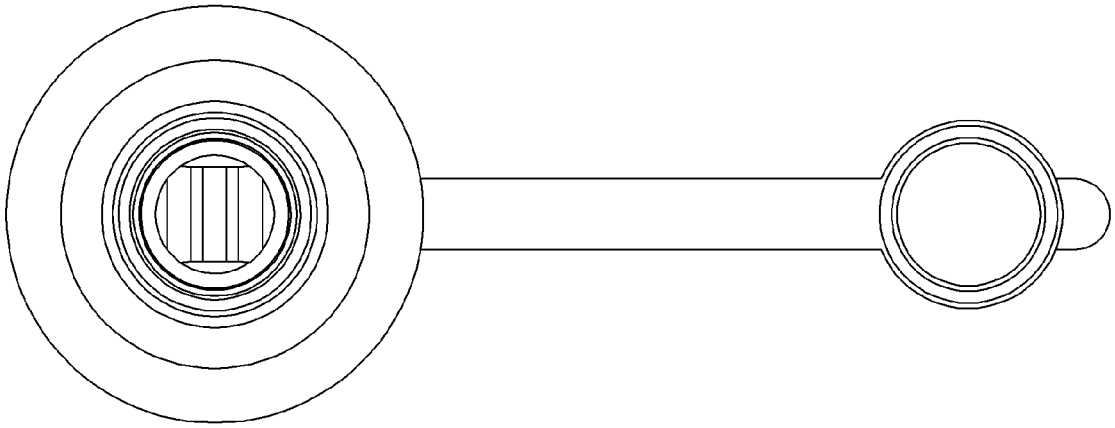
Figure 26G:
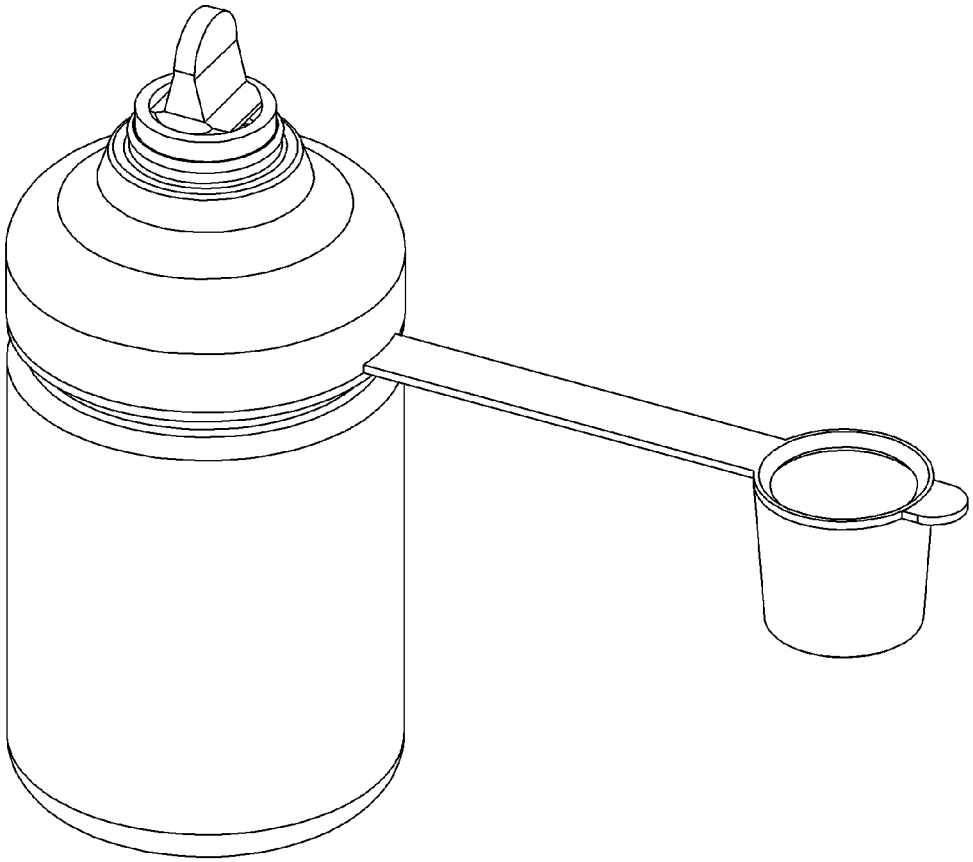
Figure 27A:
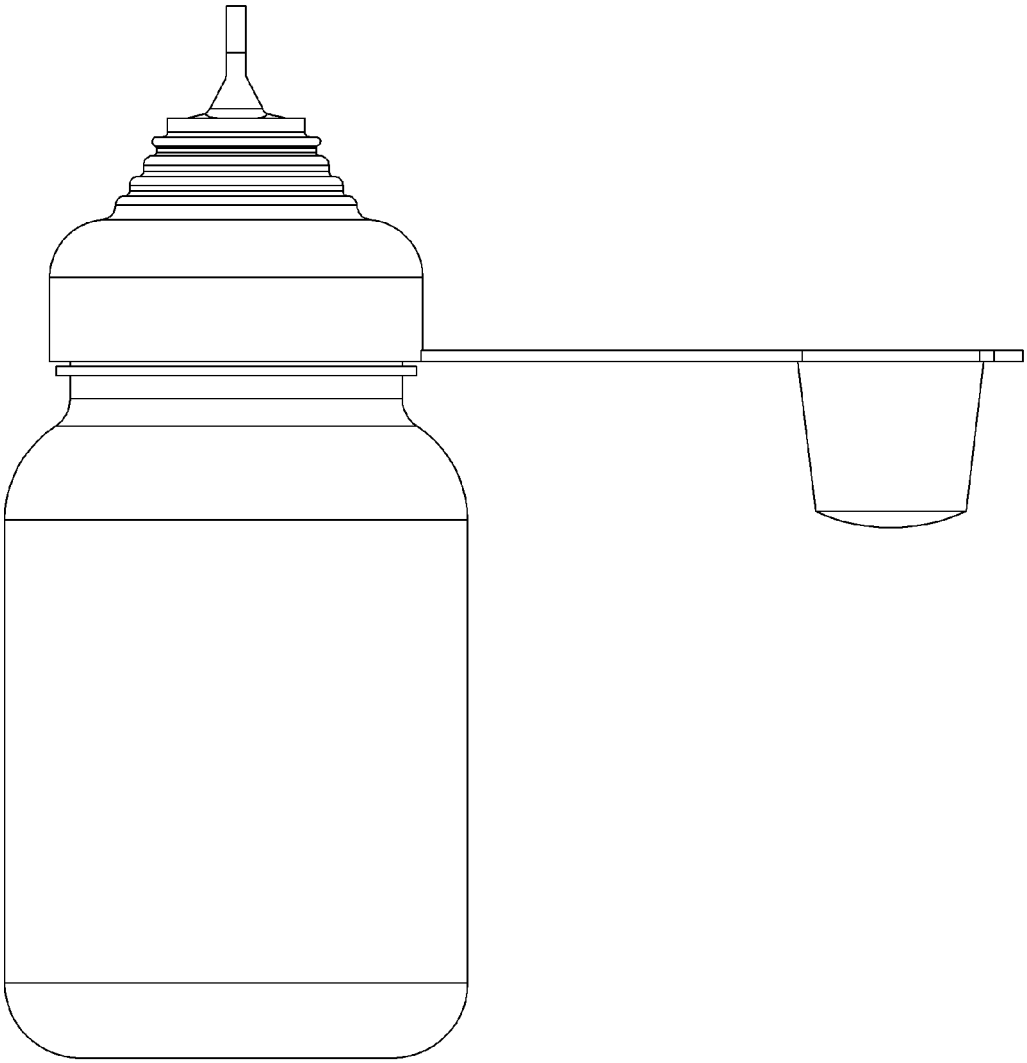
FIGS. 27A-G are a right side plan view, a left side plan view, a back plan view, a front plan view, a bottom plan view, a top plan view, and a top perspective view of an embodiment of a container body engaged with a cap with an attached cover and cover connector and the cover in a disengaged position, respectively.
Figure 27B:
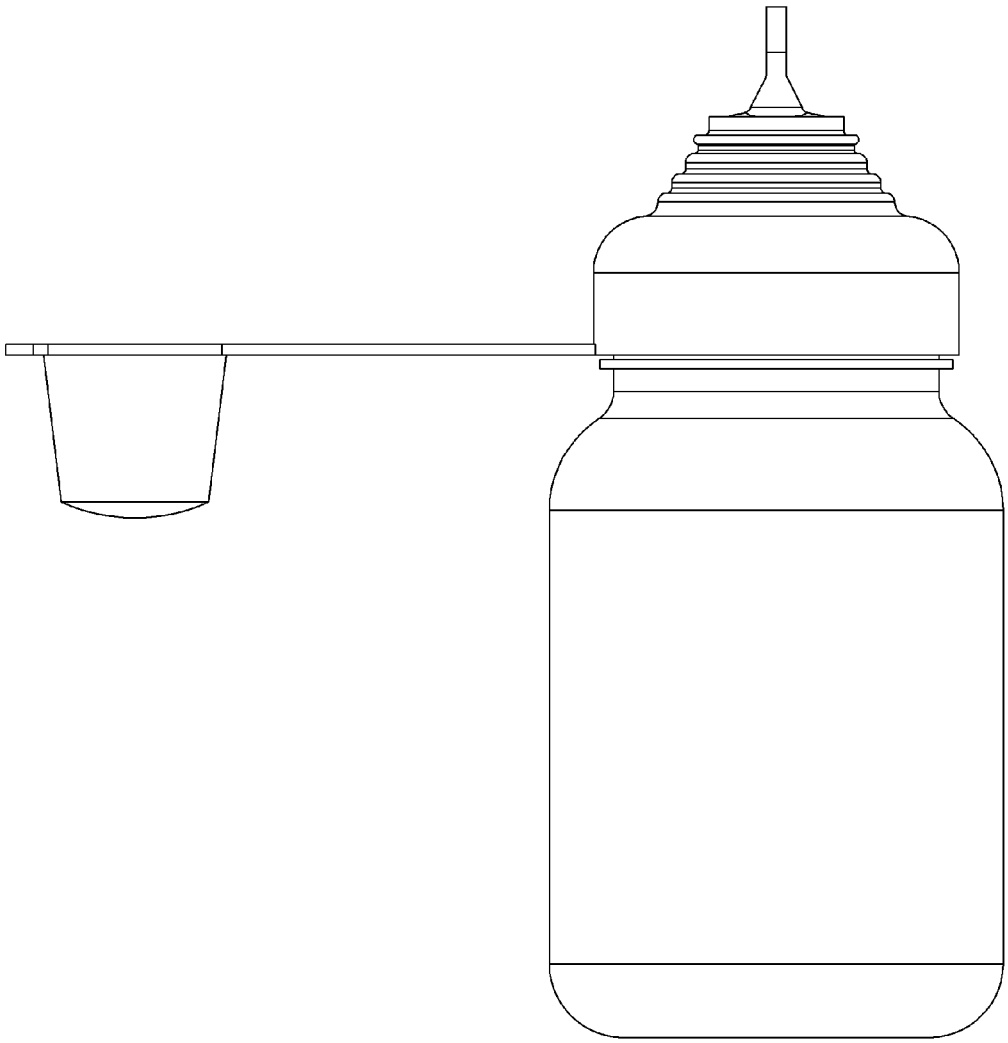
Figure 27C:
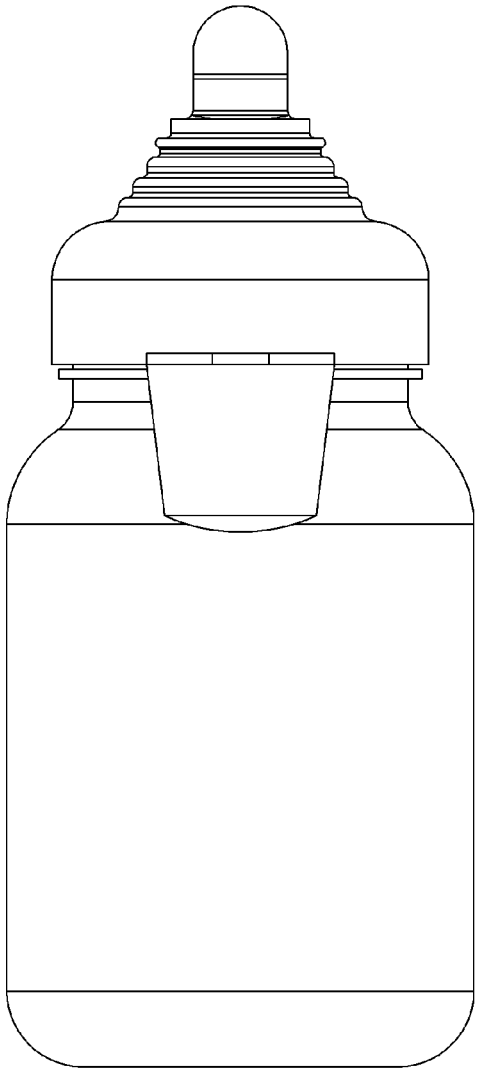
Figure 27D:
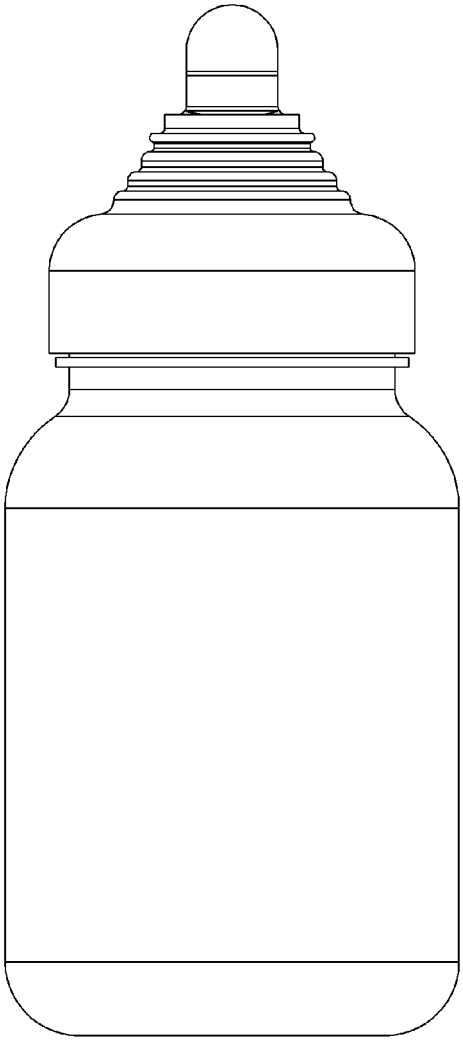
Figure 27E:
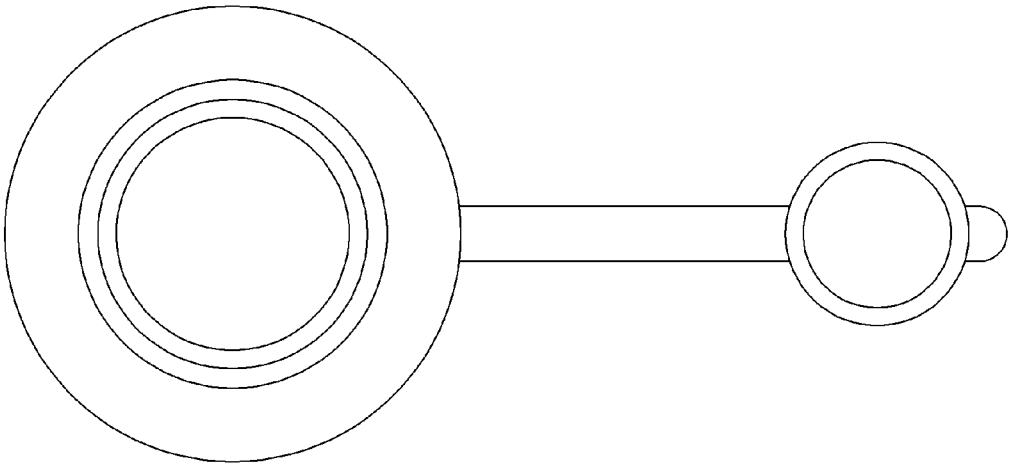
Figure 27F:
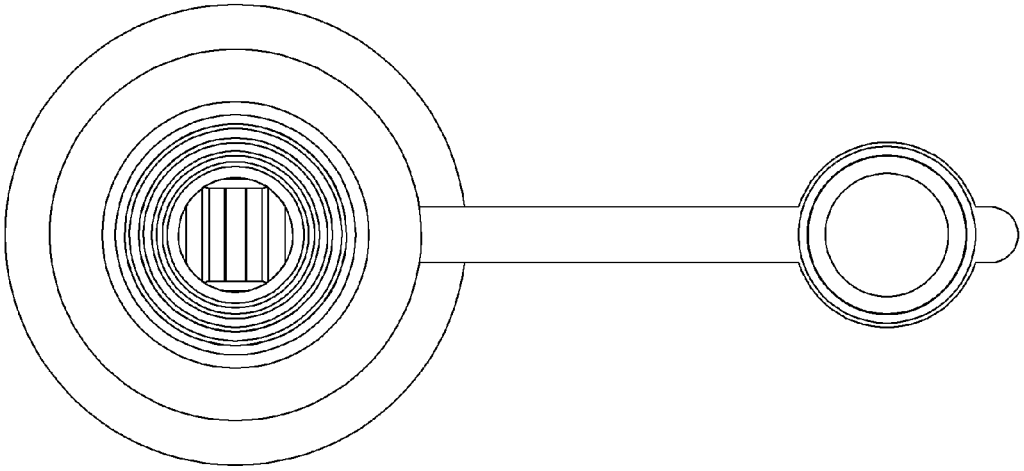
Figure 27G:
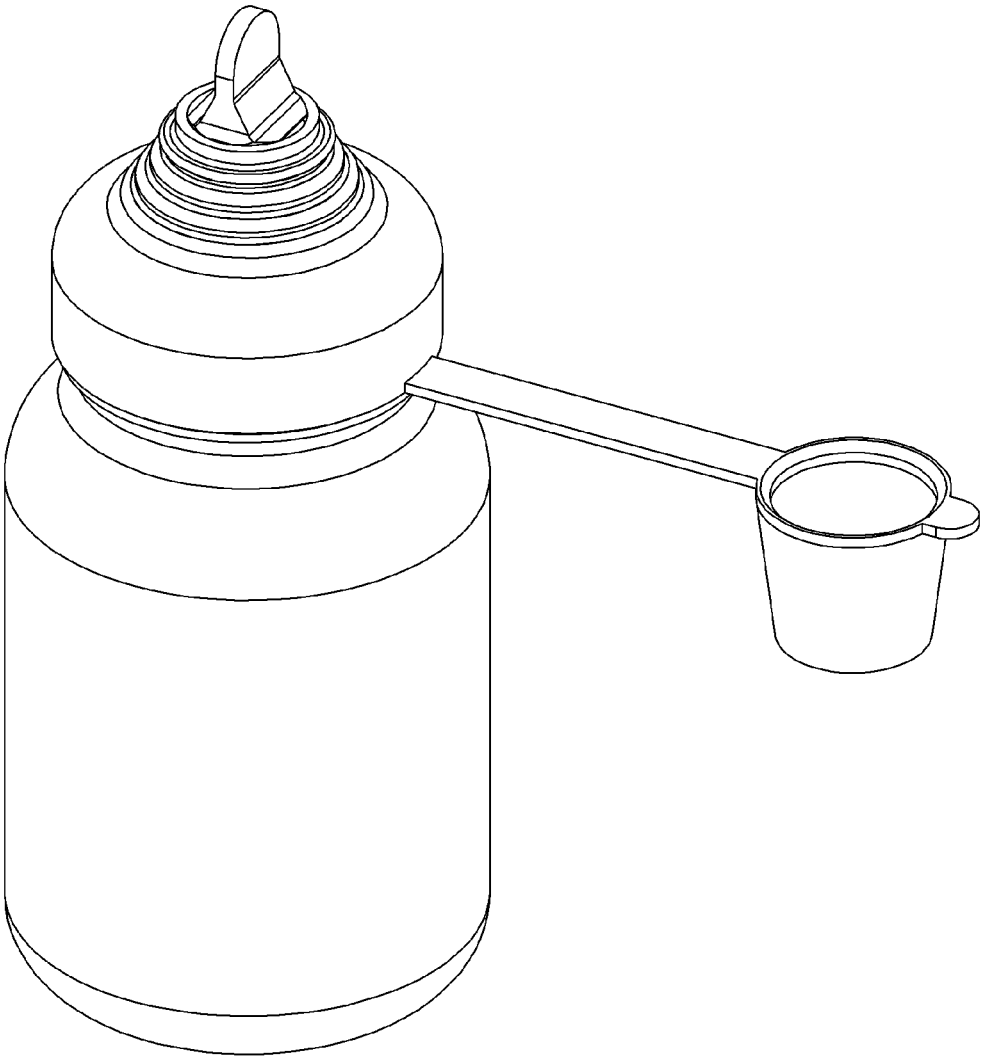
Figure 28A:
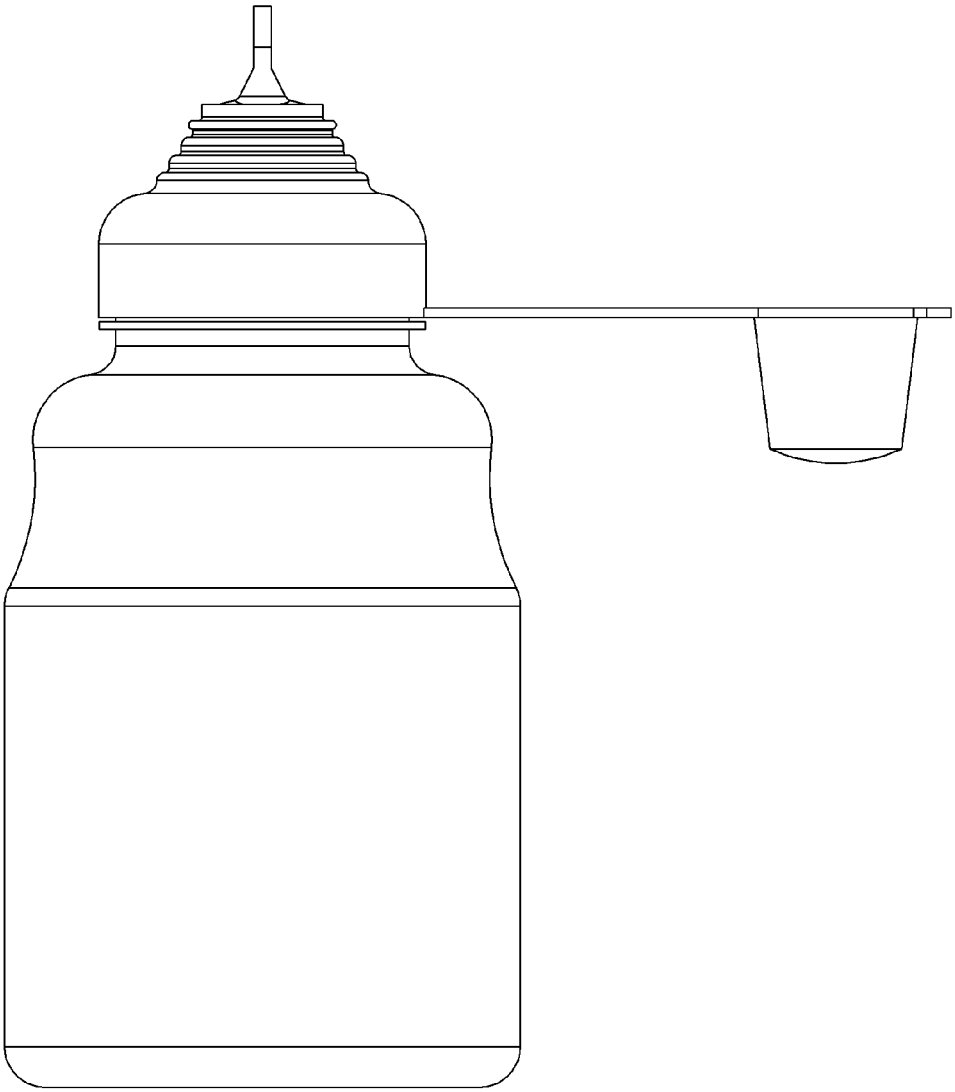
FIGS. 28A-G are a right side plan view, a left side plan view, a back plan view, a front plan view, a bottom plan view, a top plan view, and a top perspective view of an embodiment of a container body engaged with a cap with an attached cover and cover connector and the cover in a disengaged position, respectively.
Figure 28B:
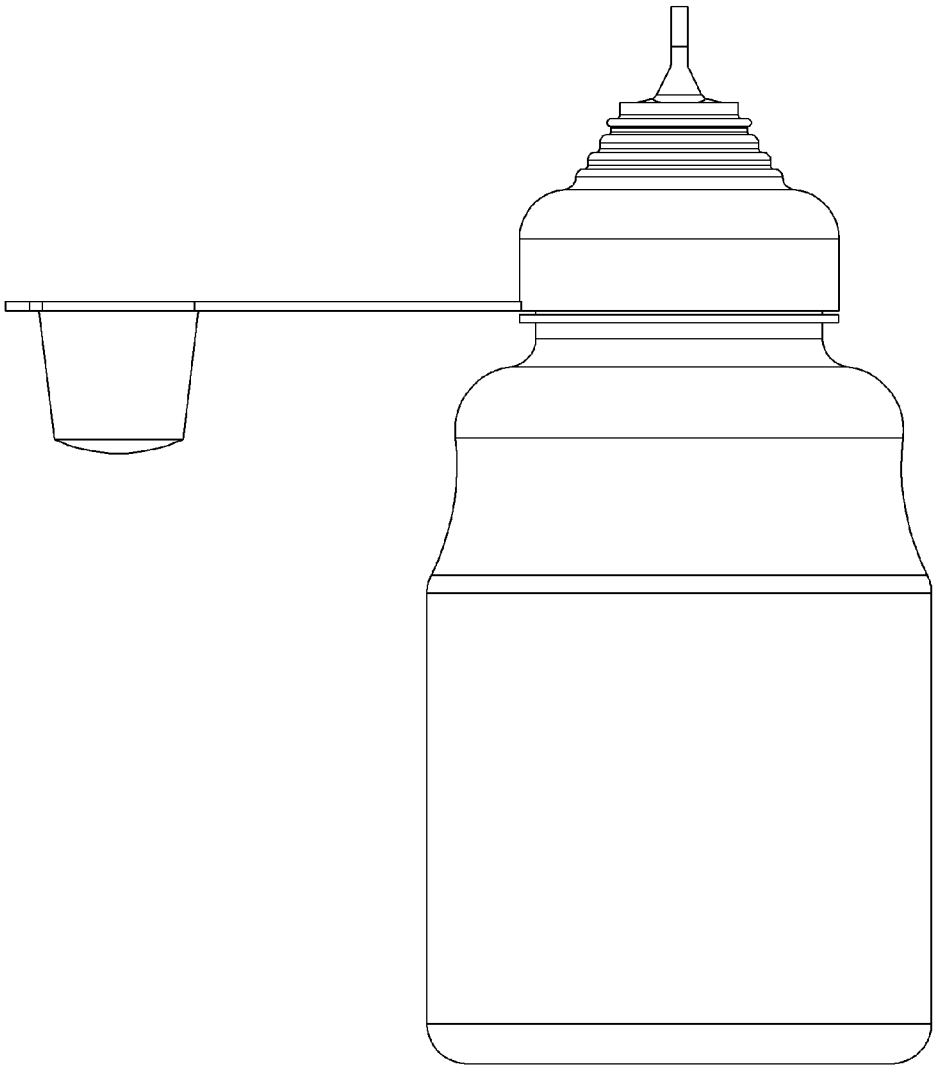
Figure 28C:
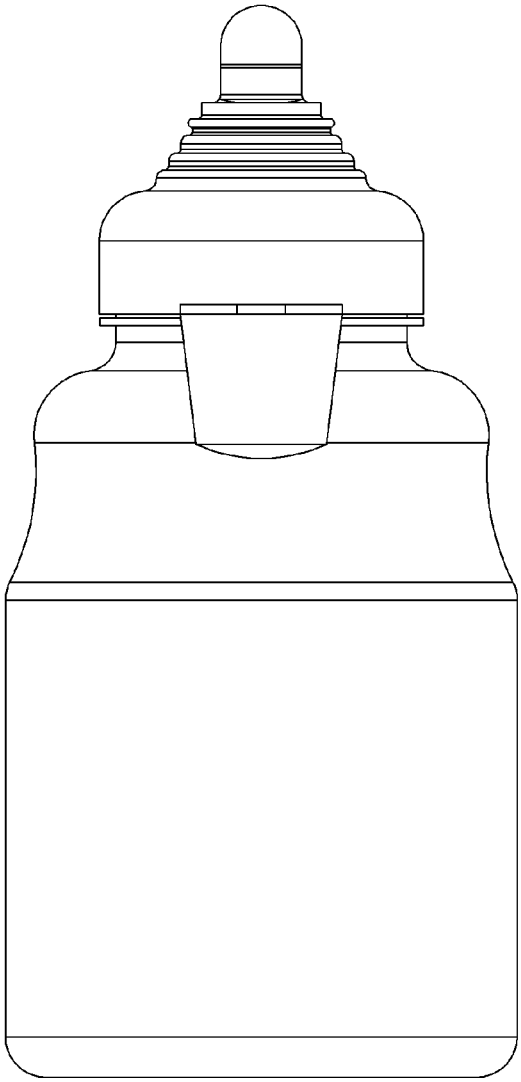
Figure 28D:
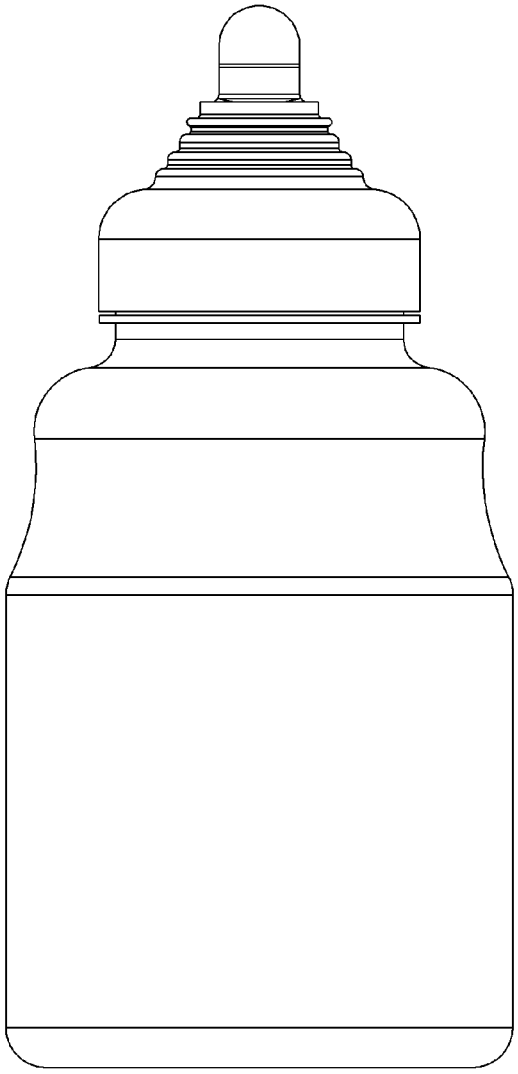
Figure 28E:
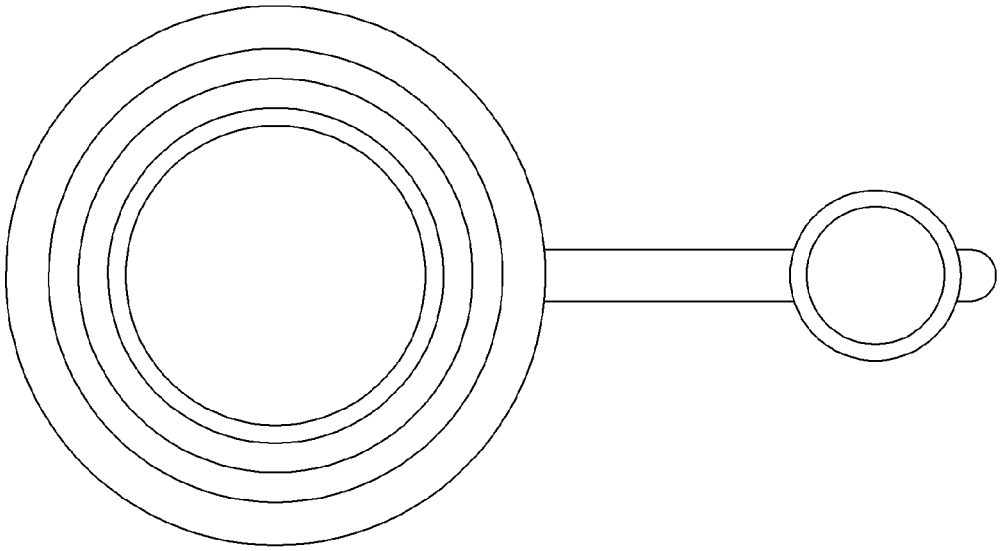
Figure 28F:
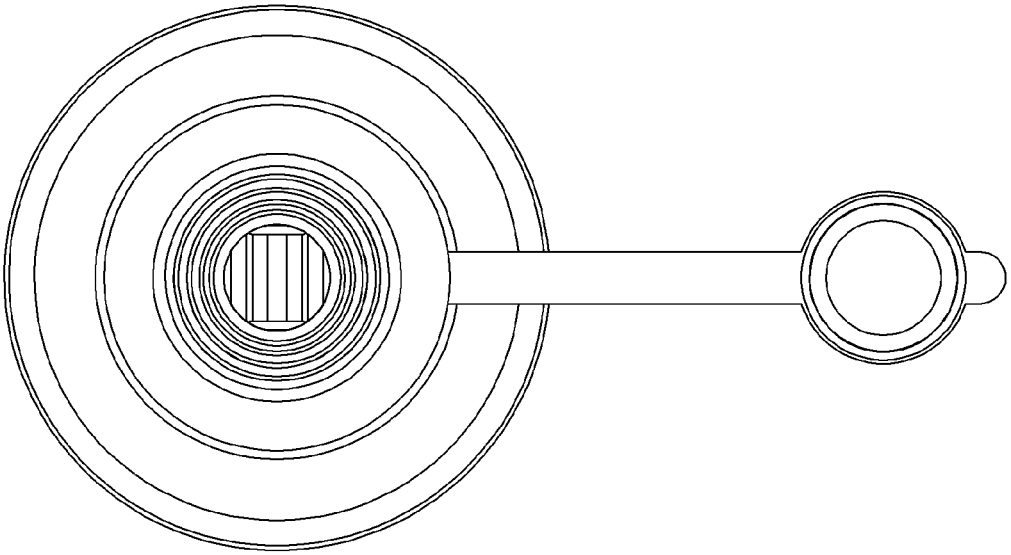
Figure 28G:
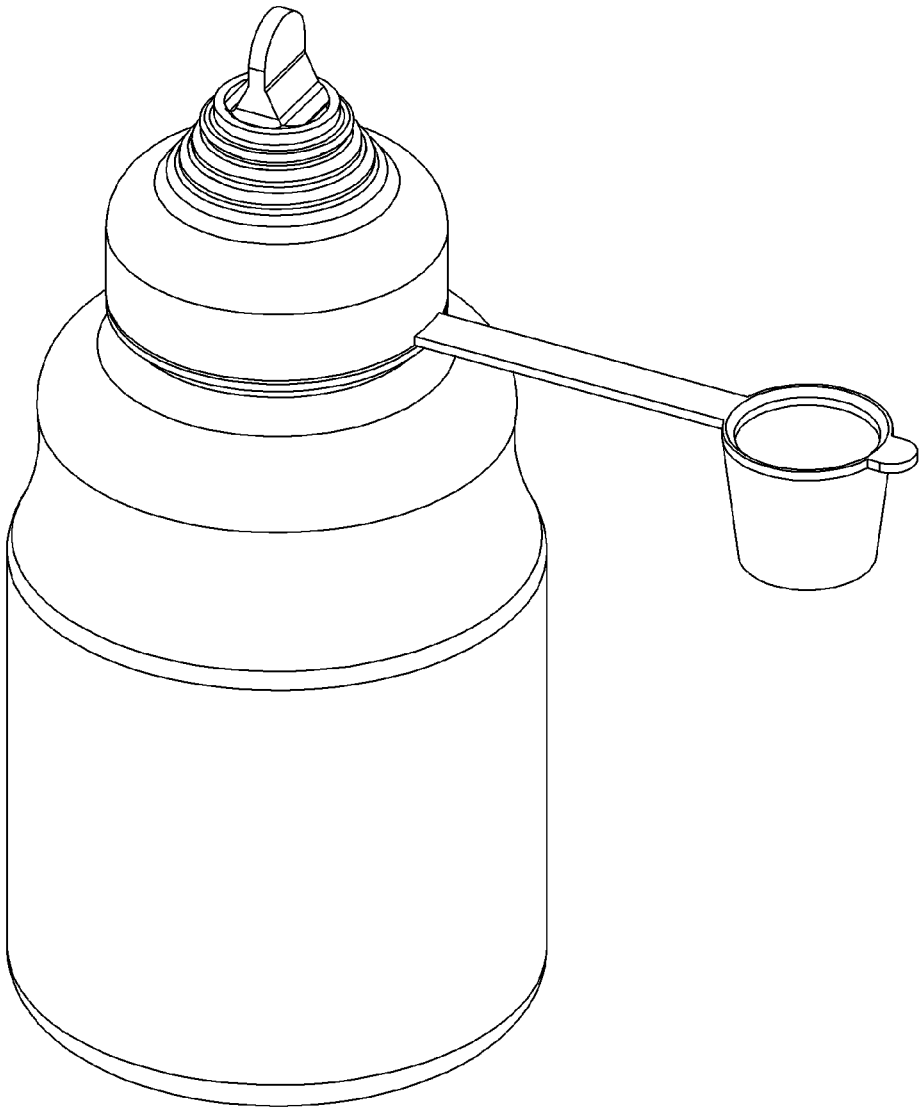
Figure 29A:
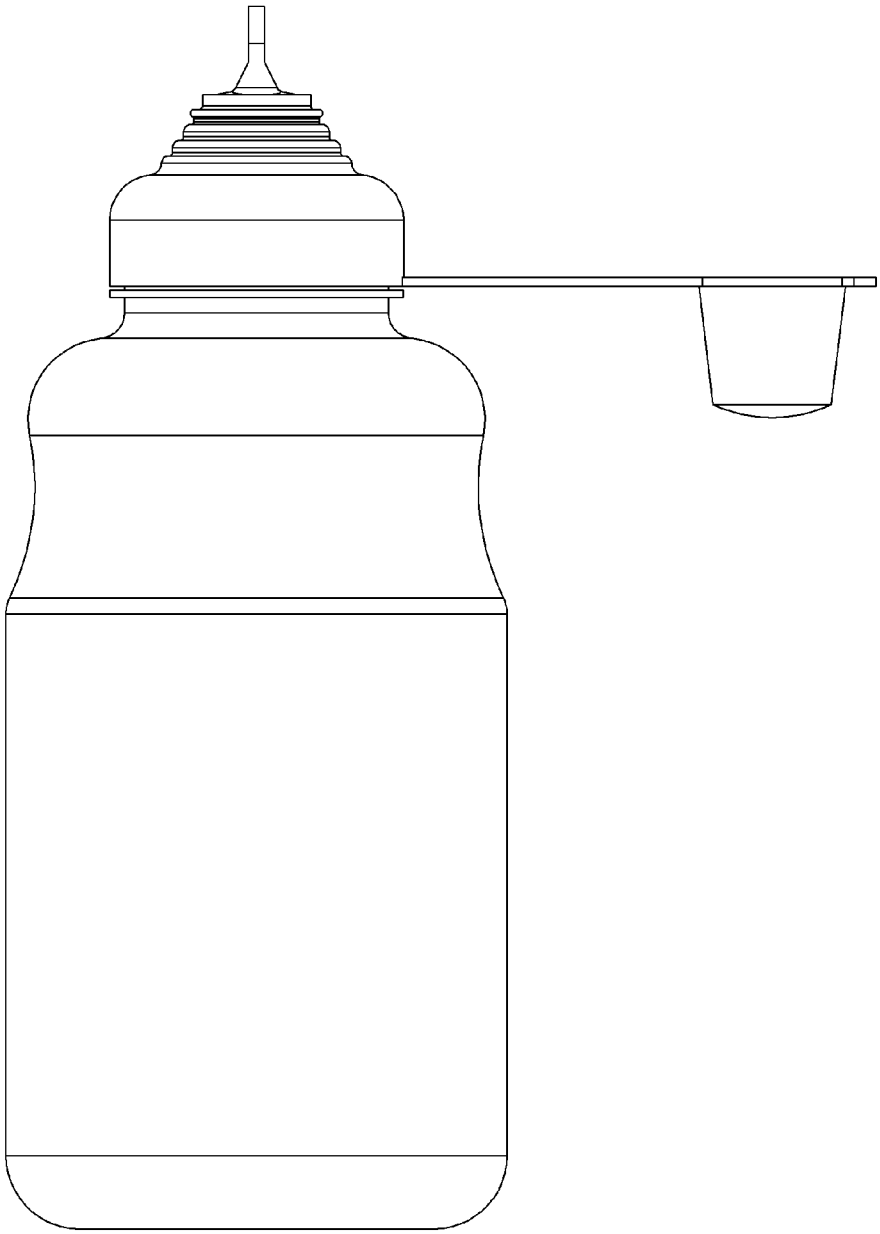
FIGS. 29A-G are a right side plan view, a left side plan view, a back plan view, a front plan view, a bottom plan view, a top plan view, and a top perspective view of an embodiment of a container body engaged with a cap with an attached cover and cover connector and the cover in a disengaged position, respectively.
Figure 29B:
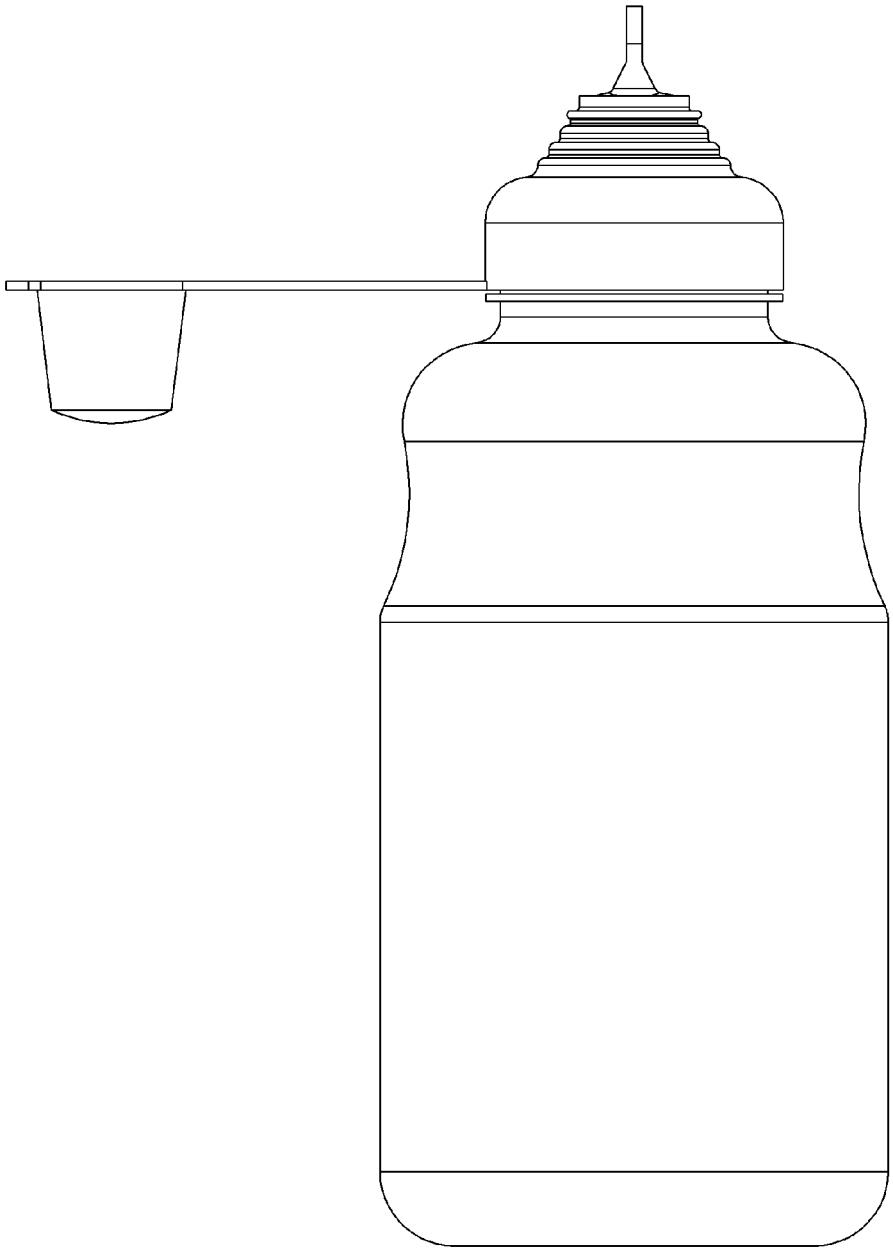
Figure 29C:
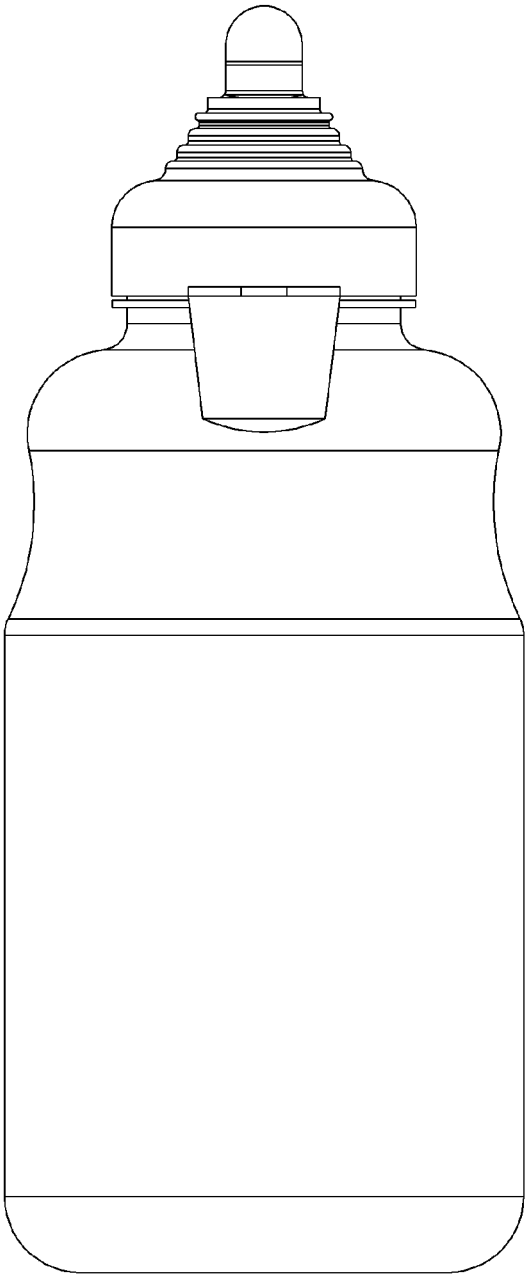
Figure 29D:
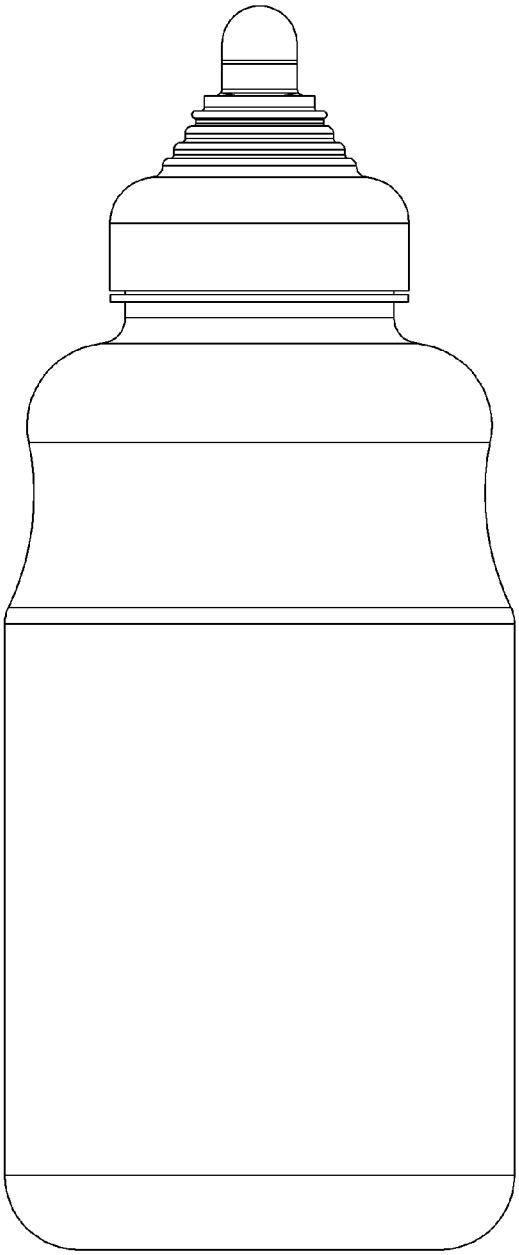
Figure 29E:
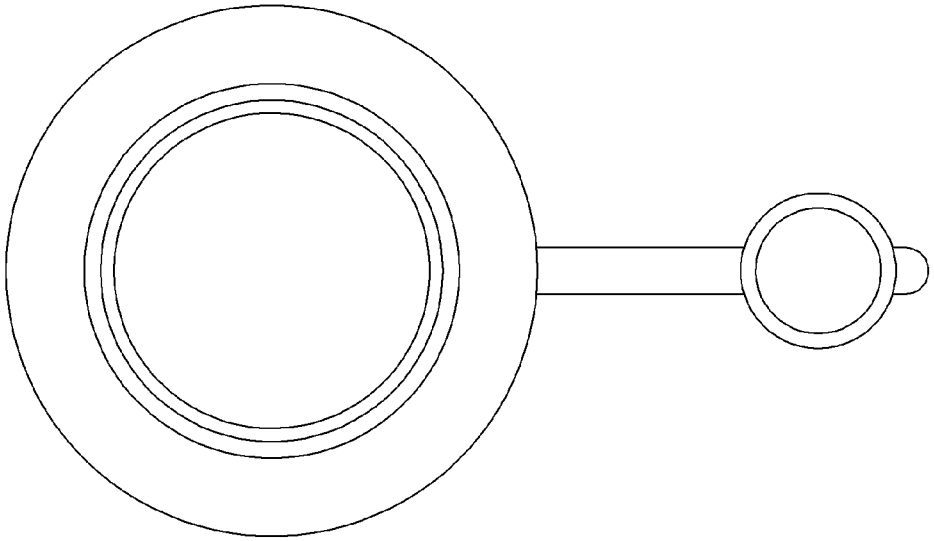
Figure 29F:
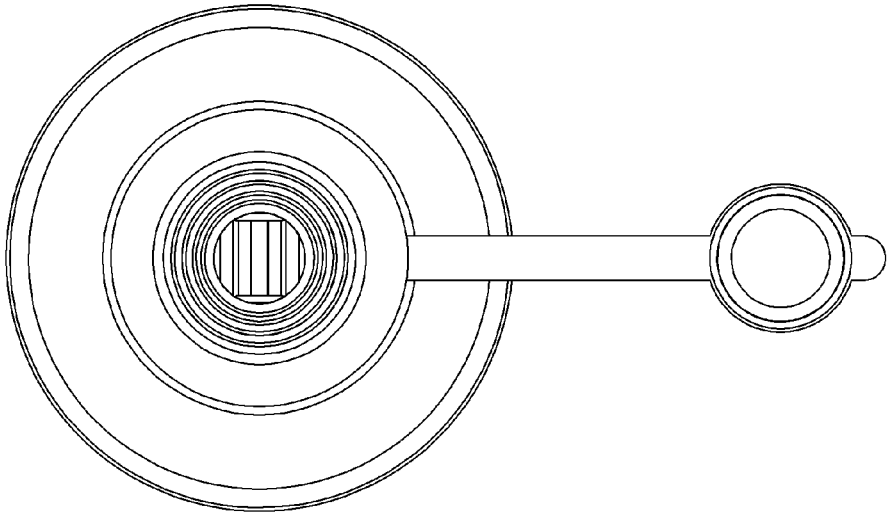
Figure 29G:
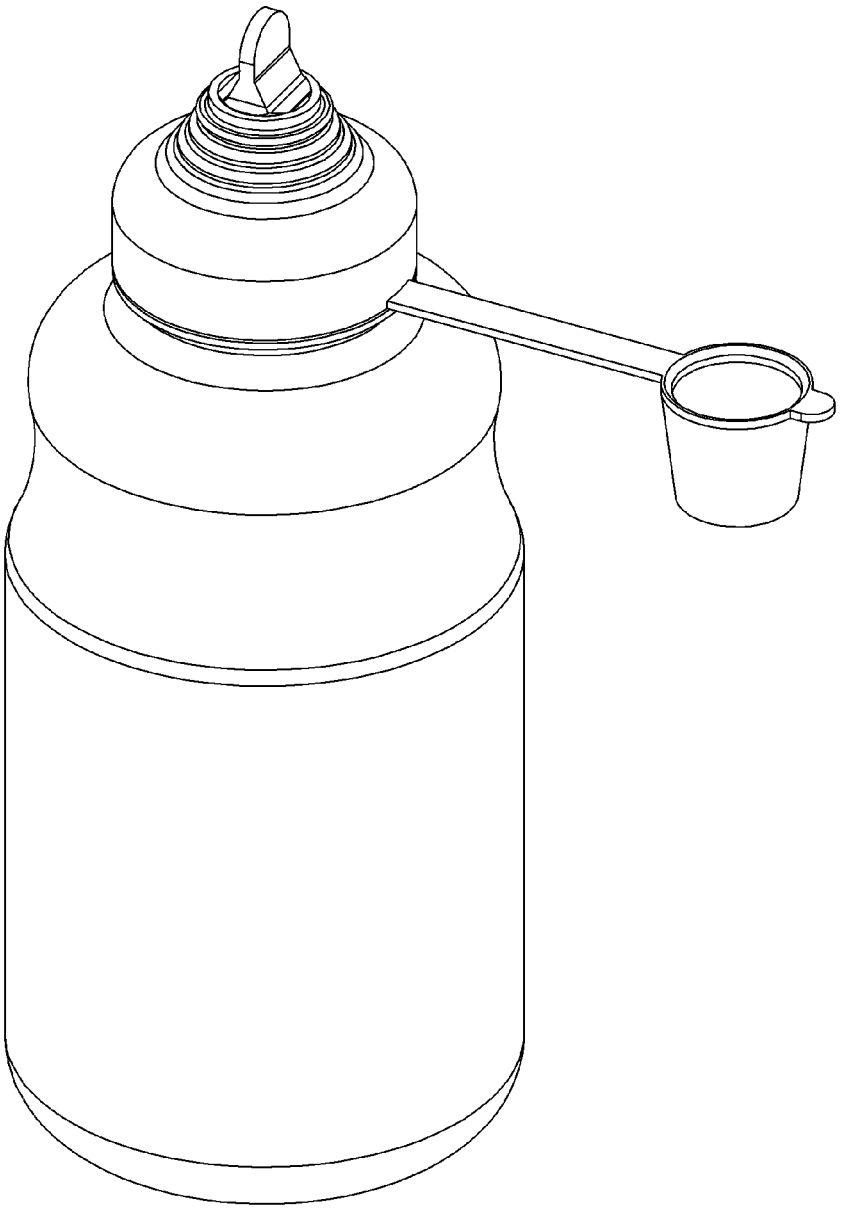

Another embodiment may contain an annular protrusion 34 extending vertically down away from the underside of the cap 12 that fits within the lip of the container body 10, as shown in FIG. 10. This annular protrusion 34 may aid in directing the contents of the container 8 out through the spout 14.

In one embodiment, the cover 18 is capable of temporarily attaching to the cap 12, as shown in FIG. 10. The cover 18 may contain a cavity 32 which is large enough to accommodate the tab 16 when the cover 18 engages the cap 12. The cover 18 may contain a lip 26 to aid in removing the cover 18 from the cap 12. The cover 18 may contain an annular feature on the cover rim 19 to aid in temporarily attaching to the cap 12. In addition, the cap 12 may contain an annular feature on its surface to aid in temporarily attaching to the cover 18.

FIGS. 11A-13C illustrate several embodiments of a cap 12 with an attached cover 18 and cover connector 20. FIGS. 14A-18D illustrate several embodiments of a container body 10. FIGS. 19A-21E illustrate several embodiments of a cap 12 without an attached cover 18 or cover connector 20. FIGS. 22A-24H illustrate several embodiments of a cap 12 with an attached cover 18 and cover connector 20. FIGS. 25A-29G illustrate several embodiments of a container body 10 engaged with a cap 12 with an attached cover 18 and cover connector 20 and the cover 18 in a disengaged position.

The many possible embodiments of this invention have many advantages over other configurations. First, the configurations described herein reduce or eliminate the need for tools, especially sharp tools like knives or scissors, to open the container. It should be noted that containers containing shot are very often opened while the user is away from his residence, often in the wilderness. While in this environment, the user is often without tools either intentionally or by mistake. These described embodiments are advantageous because they allow the user to open the container without the use of tools. Without the herein described container or necessary opening tools, the user would be forced to return home to seek the appropriate opening tools wasting considerable time and energy.

Second, users often desire to open a container containing shot while the user is wearing gloves, either due to cold weather or other preference. Other configurations of containers may require the user to use cutting tools, which can be difficult to safely operate if the user is wearing gloves. Moreover, other configurations of containers may require the user to perform a pulling motion after gripping a tab or sliding his finger into a loop. Both of these actions can be especially difficult if the user is wearing bulky gloves. The embodiments described herein are superior since a pushing motion performed by the user is easily performed, even while wearing various styles of gloves.

Finally, users often desire to open a container containing shot while he is holding something in his other hand, often the gun, pistol, or other device he is about to load. Opening a container can be especially difficult when only one hand is available. Traditional container configurations preclude the ability to open the container with one hand since they often require the user to use a cutting tool, perform some kind of pulling motion, or perhaps perform some kind of twisting motion (as is the case when a lid must be unscrewed from the container to gain access to the container's contents). All of these actions are difficult if not impossible to perform with just a single hand. However, the embodiments described herein solve that problem by making it possible to open the container with one hand. As previously described, the user may grip the container body with one hand, remove any attached cover with his thumb, and then remove an attached tab with his thumb.

It will be appreciated that although the embodiments above are described in the context of containers for shot projectiles, the invention can be used in containers of other types of products, including solid pourable products or liquid products. For any liquid or solid product that requires sealing of the opening, a sealing membrane may be disposed on the spout 14 or below the tab 16. Such membrane may be made of plastic, aluminum, or any other suitable material. Alternatively, any of the cutouts 24, including crescent-shaped cutouts, can be covered by or filled in with some plastic material, with minimal thickness, connecting the tab 16 to the surrounding spout 14.

Any features of the embodiments shown and/or described in the figures that have not been expressly described in this text, such as distances, proportions of components, etc. are also intended to form part of this disclosure. Additionally, although this invention has been disclosed in the context of various embodiments, features, aspects, and examples, it will be understood by those skilled in the art that the present invention extends beyond the specifically disclosed embodiments to other alternative embodiments and/or uses of the invention and obvious modifications and equivalents thereof. Accordingly, it should be understood that various features and aspects of the disclosed embodiments can be combined with, or substituted for, one another in order to perform varying modes of the disclosed inventions. Moreover, any component or combination of components disclosed herein can be used in other structures or configurations of containers. Thus, it is intended that the scope of the present invention herein disclosed should not be limited by the particular disclosed embodiments described above.

What is claimed is:

1. A container comprising:

a container body;

a cap, wherein the cap is tapered inwardly towards a spout having an opening;

a breakaway tab, the tab at least partially covering the opening in the spout; and at least one pre-existing cutout between the tab and the spout such that the tab does not completely seal the opening of the spout;

wherein the at least one cutout produces weakened points between the tab and spout to facilitate breaking of the tab away from the spout by pushing against the tab.

2. The container of claim 1, wherein the cap is made of a plastic material.

3. The container of claim 1, wherein the cap is of a generally frustoconical shape.

4. The container of claim 1, wherein the cap is integral with the container body.

5. The container of claim 1, wherein the cap is attachable to the container body.

6. The container of claim 1, wherein the breakaway tab has two flat opposing surfaces.

7. The container of claim 6, comprising two pre-existing cutouts, each aligned with one of the two flat opposing surfaces.

8. The container of claim 1, wherein the breakaway tab is integral with the cap.

9. The container of claim 1, wherein the at least one pre-existing cutout has a crescent shape.

10. The container of claim 1, further comprising a cover coupleable to the cap, and configured to cover the tab and the opening in the spout.

11. A container comprising:

a container body; and a cap portion; wherein the cap portion comprises:

a spout and a breakaway tab; and wherein the tab partially circumferentially covers the spout and is capable of being removed from the cap portion without the use of tools.

12. A container comprising:

a container body; and a cap comprising:

an engaging portion, a substantially frustoconical spout, a tab attached to the spout, a cover, and a cover connector;

wherein two pre-existing crescent-shaped cutouts are disposed between the tab and the spout, and the tab can be snapped off of the spout using a pushing motion.

* * * * *

UNITED STATES PATENT AND TRADEMARK OFFICE

CERTIFICATE OF CORRECTION

PATENT NO. : 8,672,165 B2
APPLICATION NO. : 13/682675
DATED : March 18, 2014
INVENTOR(S) : Tim T. Wei It is certified that error appears in the above-identified patent and that said Letters Patent is hereby corrected as shown below:

On the Title Page, (Item 57) Abstract, line 6, change "cut out" to --cutout--.

In the Specification

Column 6, line 19, change "a the" to --at the--.

Signed and Sealed this
Ninth Day of September, 2014

Michelle K. Lee

Michelle K. Lee
*Deputy Director of the United States Patent and Trademark Office*